US008515759B2

(12) United States Patent
Engdegard et al.

(10) Patent No.: US 8,515,759 B2
(45) Date of Patent: Aug. 20, 2013

(54) APPARATUS AND METHOD FOR SYNTHESIZING AN OUTPUT SIGNAL

(75) Inventors: Jonas Engdegard, Stockholm (SE); Heiko Purnhagen, Sundbyberg (SE); Barbara Resch, Solna (SE); Lars Villemoes, Jaerfaella (SE); Cornelia Falch, Nuremberg (DE); Juergen Herre, Buckendorf (DE); Johannes Hilpert, Nuremberg (DE); Andreas Hoelzer, Erlangen (DE); Leonid Terentiev, Erlangen (DE)

(73) Assignee: Dolby International AB, Amsterdam Zuid-Oost (NL)

( * ) Notice: Subject to any disclaimer, the term of this patent is extended or adjusted under 35 U.S.C. 154(b) by 910 days.

(21) Appl. No.: 12/597,740

(22) PCT Filed: Apr. 23, 2008

(86) PCT No.: PCT/EP2008/003282

§ 371 (c)(1),
(2), (4) Date: Dec. 22, 2009

(87) PCT Pub. No.: WO2008/131903

PCT Pub. Date: Nov. 6, 2008

(65) Prior Publication Data

US 2010/0094631 A1 Apr. 15, 2010

Related U.S. Application Data

(60) Provisional application No. 60/914,267, filed on Apr. 26, 2007.

(51) Int. Cl.
*G10L 13/00* (2006.01)

(52) U.S. Cl.
USPC ..... 704/258; 704/220; 704/278

(58) Field of Classification Search
USPC ..... 704/200, 204–206, 500–504, 246, 704/220–230, 278, 258; 455/450
See application file for complete search history.

(56) References Cited

U.S. PATENT DOCUMENTS 7,668,722 B2 * 2/2010 Villemoes et al. ..... 704/500
8,019,350 B2 * 9/2011 Purnhagen et al. ..... 455/450

(Continued)

FOREIGN PATENT DOCUMENTS

EP 1691348 A1 8/2006
GB 2343347 5/2000

(Continued)

OTHER PUBLICATIONS

Engdegaard J. et al.; "Proposed SAOC Working Draft Document"; Oct. 22-26, 2007; ISO/ICE JTC 1/SC 29/WG 11 M14989 MPEG (Motion Picture Expert Group) meeting, 81 pages; Shenzen, China.

(Continued)

*Primary Examiner* — Huyen X. Vo
(74) *Attorney, Agent, or Firm* — Michael A. Glenn; Perkins Coie LLP

(57) ABSTRACT

An apparatus for synthesizing a rendered output signal having a first audio channel and a second audio channel includes a decorrelator stage for generating a decorrelator signal based on a downmix signal, and a combiner for performing a weighted combination of the downmix signal and a decorrelated signal based on parametric audio object information, downmix information and target rendering information. The combiner solves the problem of optimally combining matrixing with decorrelation for a high quality stereo scene reproduction of a number of individual audio objects using a multichannel downmix.

27 Claims, 16 Drawing Sheets

(56) References Cited

U.S. PATENT DOCUMENTS

| | | | |
|---|---|---|---|
| 2004/0193430 | A1 | 9/2004 | Heo et al. |
| 2006/0165184 | A1 | 7/2006 | Purnhagen |
| 2006/0239473 | A1 | 10/2006 | Kjorling et al. |
| 2007/0112559 | A1 | 5/2007 | Schuijers et al. |

FOREIGN PATENT DOCUMENTS

| | | |
|---|---|---|
| RU | 2005123984 | 1/2006 |
| RU | 2005-135650 | 3/2006 |
| TW | 200636676 | 10/2006 |
| WO | WO-2005/086139 A1 | 9/2005 |

OTHER PUBLICATIONS

Engdegaard J. et al.; "Information Technology Coding of Audio-Visual Objects-Part x: Spatial Audio Coding"; Apr. 2005; ISO/IEC JTC 1/SC 29/WG 11 N7136, 132 pages; Busan, Korea.

Engdegaard, J. et al.; "Synthetic Ambience in Parametric Stereo Coding"; presented May 8-11, 2004; AES Convention Paper 6074 preprint, 12 pages; Berlin, Germany.

Herre, J. et al.; "The Reference Model Architecture for MPEG Spatial Audio Coding"; presented May 28-31, 2005; AES 118th Convention, Convention Paper 6447, 13 pages; Barcelona, Spain.

Int'l Organisation for Standardisation; "Call for Proposals on Spatial Audio Object Coding"; Jan. 2007; ISO/IEC JTC1/SC29/WG11, MPEG2007/N8853, 20 pages; Marrakech, Morocco.

Lee, , "International Organization for Standardization", ISO/IEC JTC 1/SC 20/WG 11; Apr. 2008, San Jose, CA, 1-5.

Breebaart, J. et al. "MPEG Spatial Audio Coding/MPEG Surround: Overview and Current Status"; Oct. 7-10, 2005. Audio Engineering Society Convention Paper presented at the 119th Convention, 17 pages.

English Translation of Korean Office Action, dated Mar. 17, 2011, in related Korean Patent Application No. 10-2009-7022395, 5 pages.

* cited by examiner

| object ID | object audio file | object audio parameter energy and correlation |
|---|---|---|
| 1 | | matrix E for each subband and for each time block |
| 2 | | |
| 3 | | |
| ⋮ | ⋮ | |
| N | | |

FIGURE 6 object covariance matrix for a time block and a subband $$E = \begin{bmatrix} e_{11} & & & & & & \\ e_{21} & e_{22} & & & & & \\ e_{31} & e_{32} & e_{33} & & & & \\ e_{41} & e_{42} & e_{43} & e_{44} & & & \\ & & & & e_{55} & & \\ \vdots & & & & & e_{66} & \\ & & & & & & \ddots \\ & & & & & & & e_{nn} \end{bmatrix}$$

$e_{ii}$: power of audio object i in the corresponding subband and time block $e_{ij}$: correlation measure between audio objects i,j in the corresponding subband and time block

FIGURE 7 downmixmatrix $$D = \begin{bmatrix} d_{11} & d_{12} & d_{13} & d_{14} \cdots d_{1N} \\ d_{21} & d_{22} & d_{23} & d_{24} \cdots d_{2N} \\ \vdots & & & \\ d_{K1} & & & \cdots d_{KN} \end{bmatrix}$$

$d_{ij}$ indicates, wether a portion or the whole object j is included in the object downmix signal i or not.

for example:

$d_{12} = 0 \Rightarrow$ object 2 is NOT included in object donwmix signal 1

$d_{23} = 1 \Rightarrow$ object 3 is FULLY included in object donwmix signal 2

$d_{24} = d_{14} = 0.5$ $\Rightarrow$ object 4 is in both object downmix signals, but with half the energy in each object downmix signal

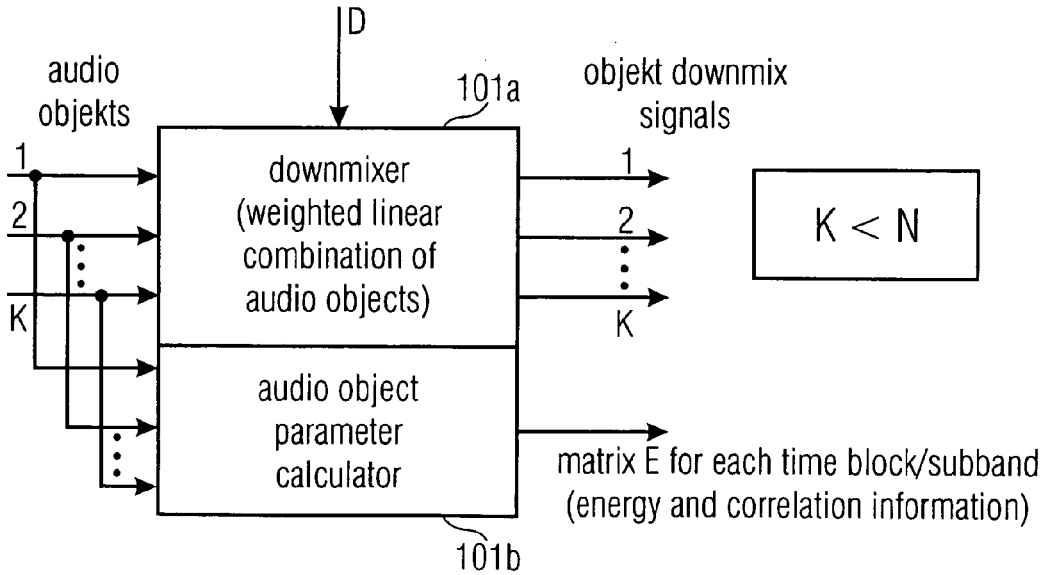

FIGURE 8 target
rendering matrix A (normally provided by user)

$$A = \begin{bmatrix} a_{11} & a_{12} & a_{13} & a_{14} & \cdots & a_{1N} \\ a_{21} & a_{22} & a_{23} & a_{24} & \cdots & a_{2N} \\ \vdots & & & & & \vdots \\ a_{M1} & \cdots & & & & a_{MN} \end{bmatrix}$$

M=2 for stereo rendering
M=M for M-channel rendering $a_{ij}$ indicates, wether a portion or the whole object is to be rendered in the output channel i or not

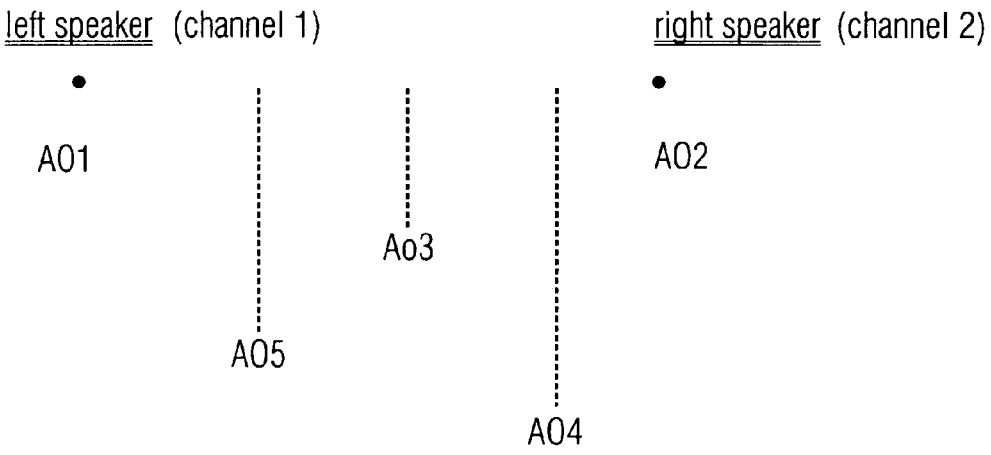

$$\text{exemplary matrix } A = \begin{bmatrix} 1 & 0 & 0.5 & 0.25 & 0.75 & 0 \\ 0 & 1 & 0.5 & 0.75 & 0.25 & 0 \end{bmatrix}$$

(object 6 is NOT to be rendered at all)

FIGURE 9

APPARATUS AND METHOD FOR SYNTHESIZING AN OUTPUT SIGNAL

CROSS-REFERENCE TO RELATED APPLICATIONS

This application is a U.S. national entry of PCT Patent Application Serial No. PCT/EP2008/003282 filed 23 Apr. 2008, and claims priority to U.S. Patent Application Ser. No. 60/914,267 filed 26 Apr. 2007, each of which is incorporated herein by reference.

BACKGROUND OF THE INVENTION

The present invention relates to synthesizing a rendered output signal such as a stereo output signal or an output signal having more audio channel signals based on an available multichannel downmix and additional control data. Specifically, the multichannel downmix is a downmix of a plurality of audio object signals.

Recent development in audio facilitates the recreation of a multichannel representation of an audio signal based on a stereo (or mono) signal and corresponding control data. These parametric surround coding methods usually comprise a parameterisation. A parametric multichannel audio decoder, (e.g. the MPEG Surround decoder defined in ISO/IEC 23003-1 [1], [2]), reconstructs M channels based on K transmitted channels, where M>K, by use of the additional control data. The control data consists of a parameterisation of the multichannel signal based on IID (Inter-channel Intensity Difference) and ICC (Inter-Channel Coherence). These parameters are normally extracted in the encoding stage and describe power ratio and correlation between channel pairs used in the up-mix process. Using such a coding scheme allows for coding at a significantly significant lower data rate than transmitting all the M channels, making the coding very efficient while at the same time ensuring compatibility with both K channel devices and M channel devices.

A much related coding system is the corresponding audio object coder [3], [4] where several audio objects are downmixed at the encoder and later upmixed, guided by control data. The process of upmixing can also be seen as a separation of the objects that are mixed in the downmix. The resulting upmixed signal can be rendered into one or more playback channels. More precisely, [3, 4] present a method to synthesize audio channels from a downmix (referred to as sum signal), statistical information about the source objects, and data that describes the desired output format. In case several downmix signals are used, these downmix signals consist of different subsets of the objects, and the upmixing is performed for each downmix channel individually.

In the case of a stereo object downmix and object rendering to stereo, or generation of a stereo signal suitable for further processing by for instance an MPEG surround decoder, it is known that a significant performance advantage is achieved by joint processing of the two channels with a time and frequency dependent matrixing scheme. Outside the scope of audio object coding, a related technique is applied for partially transforming one stereo audio signal into another stereo audio signal in WO2006/103584. It is also well known that for a general audio object coding system it is necessitated to introduce the addition of a decorrelation process to the rendering in order to perceptually reproduce the desired reference scene. However, a description of a jointly optimized combination of matrixing and decorrelation is not known. A simple combination of the conventional methods leads either to inefficient and inflexible use of the capabilities offered by a multichannel object downmix or to a poor stereo image quality in the resulting object decoder renderings.

REFERENCES

[1] L. Villemoes, J. Herre, J. Breebaart, G. Hotho, S. Disch, H. Purnhagen, and K. Kjörling, "MPEG Surround: The Forthcoming ISO Standard for Spatial Audio Coding," in 28th International AES Conference, The Future of Audio Technology Surround and Beyond, Piteå, Sweden, Jun. 30-Jul. 2, 2006.

[2] J. Breebaart, J. Herre, L. Villemoes, C. Jin, K. Kjörling, J. Plogsties, and J. Koppens, "Multi-Channels goes Mobile: MPEG Surround Binaural Rendering," in 29th International AES Conference, Audio for Mobile and Handheld Devices, Seoul, Sep. 2-4, 2006.

[3] C. Faller, "Parametric Joint-Coding of Audio Sources," Convention Paper 6752 presented at the 120th AES Convention, Paris, France, May 20-23, 2006.

[4] C. Faller, "Parametric Joint-Coding of Audio Sources," Patent application PCT/EP2006/050904, 2006.

SUMMARY

According to an embodiment, an apparatus for synthesising an output signal having a first audio channel signal and a second audio channel signal may have; a decorrelator stage for generating a decorrelated signal having a decorrelated single channel signal or a decorrelated first channel signal and a decorrelated second channel signal from a downmix signal, the downmix signal having a first audio object downmix signal and a second audio object downmix signal, the downmix signal representing a downmix of a plurality of audio object signals in accordance with downmix information; and a combiner for performing a weighted combination of the downmix signal and the decorrelated signal using weighting factors, wherein the combiner is operative to calculate the weighting factors for the weighted combination from the downmix information, from target rendering information indicating virtual positions of the audio objects in a virtual replay set-up, and parametric audio object information describing the audio objects.

According to another embodiment, a method of synthesising an output signal having a first audio channel signal and a second audio channel signal may have the steps of: generating a decorrelated signal having a decorrelated single channel signal or a decorrelated first channel signal and a decorrelated second channel signal from a downmix signal, the downmix signal having a first audio object downmix signal and a second audio object downmix signal, the downmix signal representing a downmix of a plurality of audio object signals in accordance with downmix information; and performing a weighted combination of the downmix signal and the decorrelated signal using weighting factors, based on a calculation of the weighting factors for the weighted combination from the downmix information, from target rendering information indicating virtual positions of the audio objects in a virtual replay set-up, and parametric audio object information describing the audio objects.

Another embodiment may have a computer program having a program code adapted for performing the inventive method, when running on a processor.

The present invention provides a synthesis of a rendered output signal having two (stereo) audio channel signals or more than two audio channel signals. In case of many audio objects, a number of synthesized audio channel signals is, however, smaller than the number of original audio objects.

However, when the number of audio objects is small (e.g. 2) or the number of output channels is 2, 3 or even larger, the number of audio output channels can be greater than the number of objects. The synthesis of the rendered output signal is done without a complete audio object decoding operation into decoded audio objects and a subsequent target rendering of the synthesized audio objects. Instead, a calculation of the rendered output signals is done in the parameter domain based on downmix information, on target rendering information and on audio object information describing the audio objects such as energy information and correlation information. Thus, the number of decorrelators which heavily contribute to the implementation complexity of a synthesizing apparatus can be reduced to be smaller than the number of output channels and even substantially smaller than the number of audio objects. Specifically, synthesizers with only a single decorrelator or two decorrelators can be implemented for high quality audio synthesis. Furthermore, due to the fact that a complete audio object decoding and subsequent target rendering is not to be conducted, memory and computational resources can be saved. Furthermore, each operation introduces potential artifacts. Therefore, the calculation in accordance with the present invention is advantageously done in the parameter domain only so that the only audio signals which are not given in parameters but which are given as, for example, time domain or subband domain signals are the at least two object down-mix signals. During the audio synthesis, they are introduced into the decorrelator either in a downmixed form when a single decorrelator is used or in a mixed form, when a decorrelator for each channel is used. Other operations done on the time domain or filter bank domain or mixed channel signals are only weighted combinations such as weighted additions or weighted subtractions, i.e., linear operations. Thus, the introduction of artifacts due to a complete audio object decoding operation and a subsequent target rendering operation are avoided.

The audio object information is given as an energy information and correlation information, for example in the form of an object covariance matrix. Furthermore, it is advantageous that such a matrix is available for each subband and each time block so that a frequency-time map exists, where each map entry includes an audio object covariance matrix describing the energy of the respective audio objects in this subband and the correlation between respective pairs of audio objects in the corresponding subband. Naturally, this information is related to a certain time block or time frame or time portion of a subband signal or an audio signal.

The audio synthesis is performed into a rendered stereo output signal having a first or left audio channel signal and a second or right audio channel signal. Thus, one can approach an application of audio object coding, in which the rendering of the objects to stereo is as close as possible to the reference stereo rendering.

In many applications of audio object coding it is of great importance that the rendering of the objects to stereo is as close as possible to the reference stereo rendering. Achieving a high quality of the stereo rendering, as an approximation to the reference stereo rendering is important both in terms of audio quality for the case where the stereo rendering is the final output of the object decoder, and in the case where the stereo signal is to be fed to a subsequent device, such as an MPEG Surround decoder operating in stereo downmix mode.

The present invention provides a jointly optimized combination of a matrixing and decorrelation method which enables an audio object decoder to exploit the full potential of an audio object coding scheme using an object downmix with more than one channel.

Embodiments of the present invention comprise the following features:

an audio object decoder for rendering a plurality of individual audio objects using a multichannel downmix, control data describing the objects, control data describing the downmix, and rendering information, comprising a stereo processor comprising an enhanced matrixing unit, operational in linearly combining the multichannel downmix channels into a dry mix signal and a decorrelator input signal and subsequently feeding the decorrelator input signal into a decorrelator unit, the output signal of which is linearly combined into a signal which upon channel-wise addition with the dry mix signal constitutes the stereo output of the enhanced matrixing unit; or a matrix calculator for computing the weights for linear combination used by the enhanced matrixing unit, based on the control data describing the objects, the control data describing the downmix and stereo rendering information.

BRIEF DESCRIPTION OF THE DRAWINGS

Embodiments of the present invention will be detailed subsequently referring to the appended drawings, in which:

FIG. 6 is a map indicating several audio objects identified by a certain ID, having an object audio file, and a joint audio object information matrix E;

FIG. 7 is an explanation of an object covariance matrix E of FIG. 6:

FIG. 8 is a downmix matrix and an audio object encoder controlled by the downmix matrix D;

FIG. 9 is a target rendering matrix A which is normally provided by a user and an example for a specific target rendering scenario;

DETAILED DESCRIPTION OF THE INVENTION

The below-described embodiments are merely illustrative for the principles of the present invention for APPARATUS AND METHOD FOR SYNTHESIZING AN OUTPUT SIGNAL. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

Figure 1:
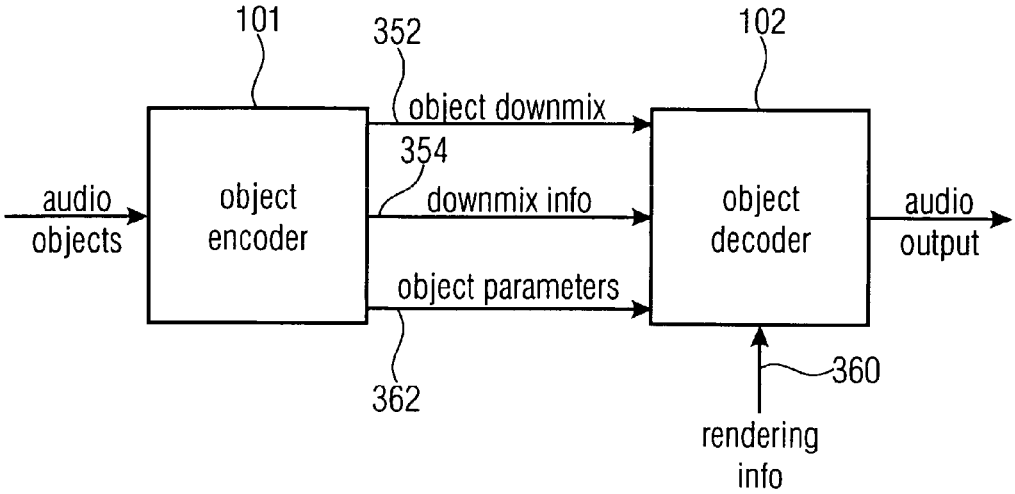
FIG. 1 is the operation of audio object coding comprising encoding and decoding.

FIG. 1 illustrates the operation of audio object coding, comprising an object encoder 101 and an object decoder 102. The spatial audio object encoder 101 encodes N objects into an object downmix consisting of K>1 audio channels, according to encoder parameters. Information about the applied downmix weight matrix D is output by the object encoder together with optional data concerning the power and correlation of the downmix. The matrix D is often constant over time and frequency, and therefore represents a relatively small amount of information. Finally, the object encoder extracts object parameters for each object as a function of both time and frequency at a resolution defined by perceptual considerations. The spatial audio object decoder 102 takes the object downmix channels, the downmix info, and the object parameters (as generated by the encoder) as input and generates an output with M audio channels for presentation to the user. The rendering of N objects into M audio channels makes use of a rendering matrix provided as user input to the object decoder.

Figure 2A:
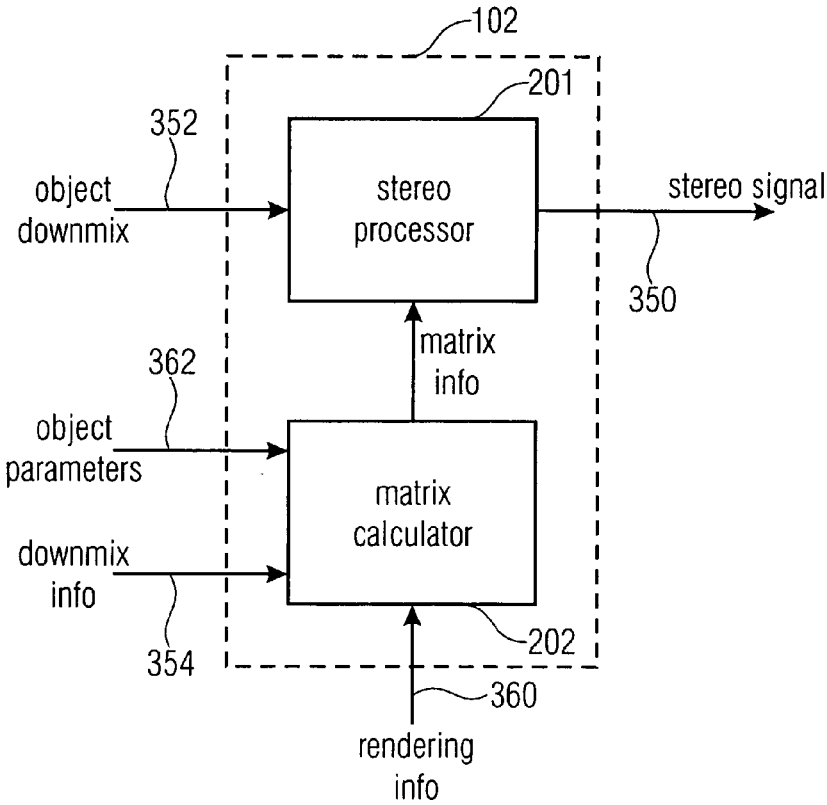
FIG. 2*a* is the operation of audio object decoding to stereo.

FIG. 2*a* illustrates the components of an audio object decoder 102 in the case where the desired output is stereo audio. The audio object downmix is fed into a stereo processor 201, which performs signal processing leading to a stereo audio output. This processing depends on matrix information furnished by the matrix calculator 202. The matrix information is derived from the object parameters, the downmix information and the supplied object rendering information, which describes the desired target rendering of the N objects into stereo by means of a rendering matrix.

Figure 2B:
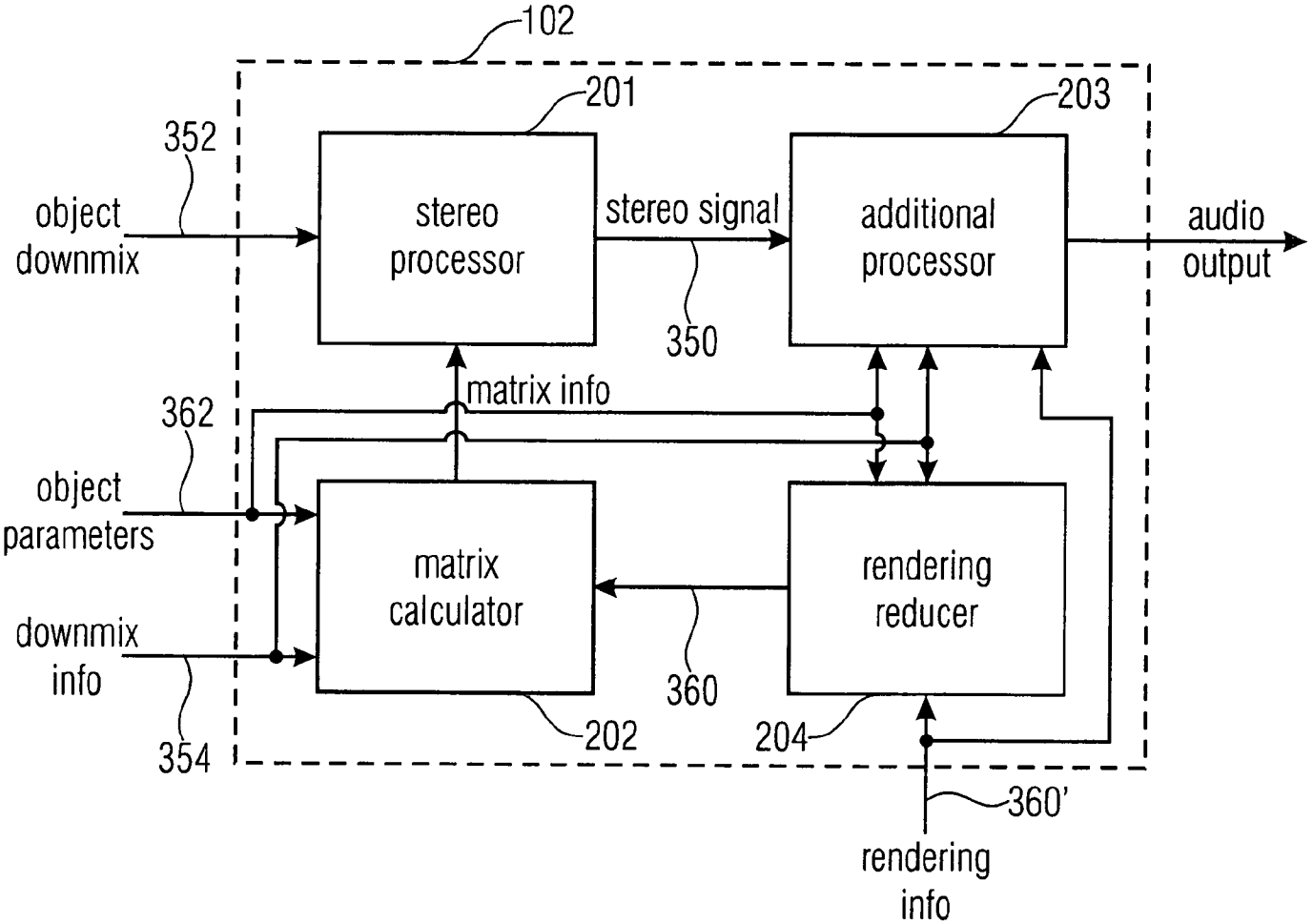
FIG. 2*b* is the operation of audio object decoding.

FIG. 2*b* illustrates the components of an audio object decoder 102 in the case where the desired output is a general multichannel audio signal. The audio object downmix is fed into a stereo processor 201, which performs signal processing leading to a stereo signal output. This processing depends on matrix information furnished by the matrix calculator 202. The matrix information is derived from the object parameters, the downmix information and a reduced object rendering information, which is output by the rendering reducer 204. The reduced object rendering information describes the desired rendering of the N objects into stereo by means of a rendering matrix, and it is derived from the rendering info describing the rendering of N objects into M audio channels supplied to the audio object decoder 102, the object parameters, and the object downmix info. The additional processor 203 converts the stereo signal furnished by the stereo processor 201 into the final multichannel audio output, based on the rendering info, the downmix info and the object parameters. An MPEG Surround decoder operating in stereo downmix mode is a typical principal component of the additional processor 203.

Figure 3A:
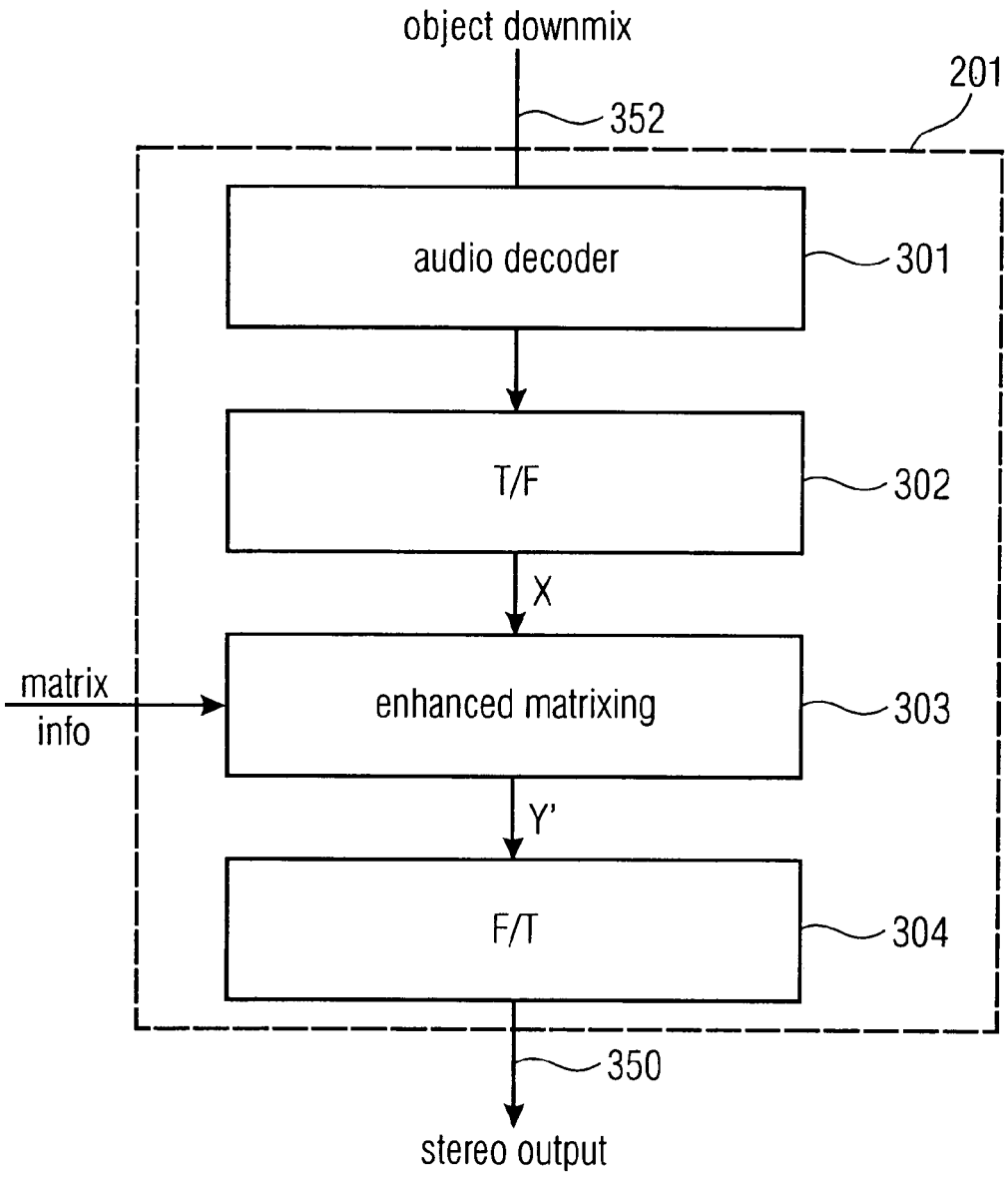
FIG. 3*a* is the structure of a stereo processor.

FIG. 3*a* illustrates the structure of the stereo processor 201. Given the transmitted object downmix in the format of a bitstream output from a K channel audio encoder, this bitstream is first decoded by the audio decoder 301 into K time domain audio signals. These signals are then all transformed to the frequency domain by T/F unit 302. The time and frequency varying inventive enhanced matrixing defined by the matrix info supplied to the stereo processor 201 is performed on the resulting frequency domain signals X by the enhanced matrixing unit 303. This unit outputs a stereo signal Y' in the frequency domain which is converted into time domain signal by the F/T unit 304.

Figure 3B:
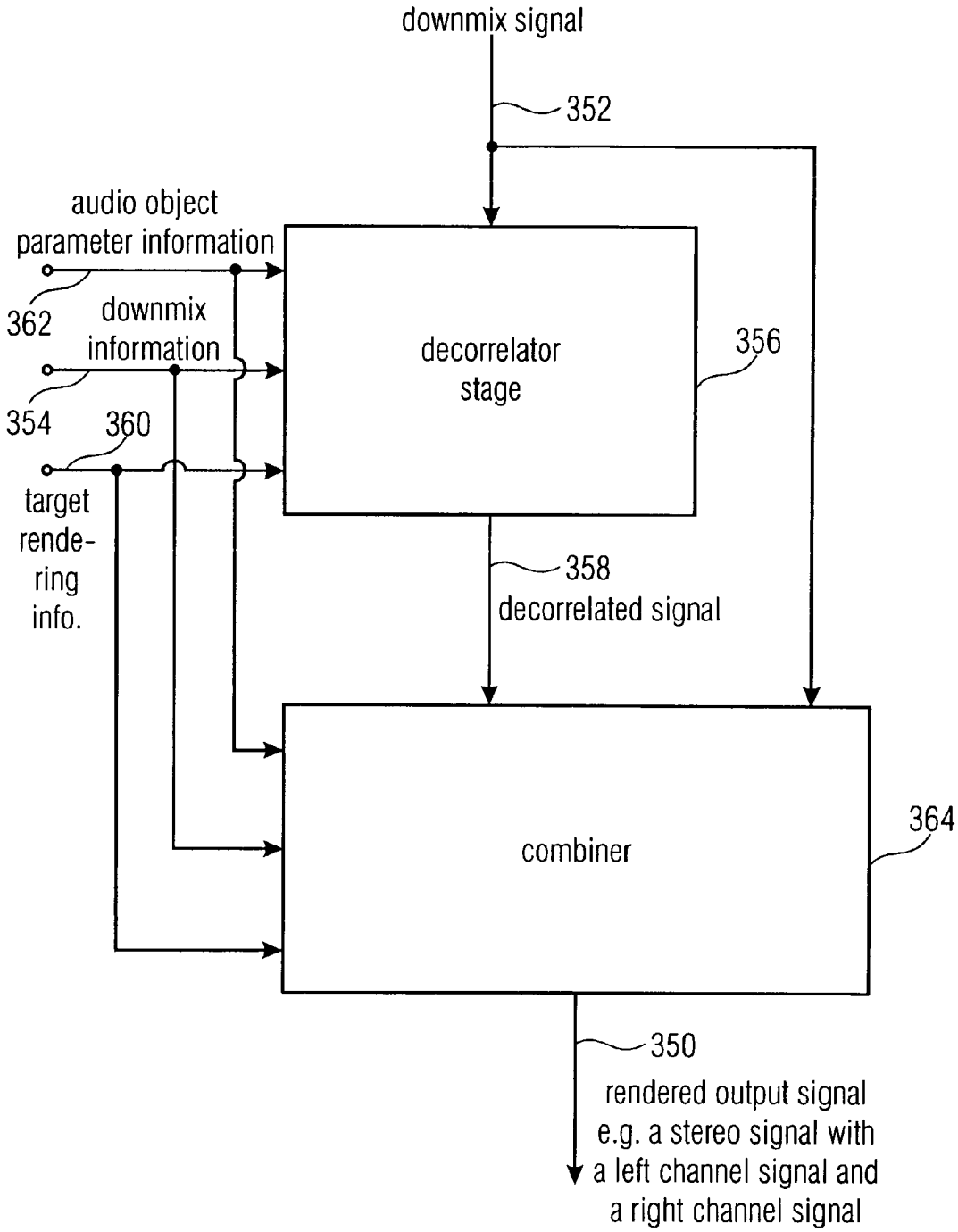
FIG. 3*b* is an apparatus for synthesizing a rendered output signal.

FIG. 3*b* illustrates an apparatus for synthesizing a rendered output signal 350 having a first audio channel signal and a second audio channel signal in the case of a stereo rendering operation, or having more than two output channel signals in the case of a higher channel rendering. However, for a higher number of audio objects such as three or more the number of output channels is smaller than the number of original audio objects, which have contributed to the down-mix signal 352. Specifically, the downmix signal 352 has at least a first object downmix signal and a second object downmix signal, wherein the downmix signal represents a downmix of a plurality of audio object signals in accordance with downmix information 354. Specifically, the inventive audio synthesizer as illustrated in FIG. 3*b* includes a decorrelator stage 356 while generating a decorrelated signal having a decorrelated single channel signal or a first decorrelated channel signal and a second decorrelated channel signal in the case of two decorrelators or having more than two decorrelator channel signals in the case of an implementation having three or more decorrelators. However, a smaller number of decorrelators and, therefore, a smaller number of decorrelated channel signals are advantageous over a higher number due to the implementation complexity incurred by a decorrelator. The number of decorrelators is smaller than the number of audio objects included in the downmix signal 352 and will be equal to the number of channel signals in the output signal 352 or smaller than the number of audio channel signals in the rendered output signal 350. For a small number of audio objects (e.g. 2 or 3), however, the number of decorrelators can be equal or even greater than the number of audio objects.

As indicated in FIG. 3*b*, the decorrelator stage receives, as an input, the downmix signal 352 and generates, as an output signal, the decorrelated signal 358. In addition to the downmix information 354, target rendering information 360 and audio object parameter information 362 are provided. Specifically, the audio object parameter information is at least used in a combiner 364 and can optionally be used in the decorrelator stage 356 as will be described later on. The audio object parameter information 362 comprises energy and correlation information describing the audio object in a parameterized form such as a number between 0 and 1 or a certain number which is defined in a certain value range, and which indicates an energy, a power or a correlation measure between two audio objects as described later on.

The combiner 364 is configured for performing a weighted combination of the downmix signal 352 and the decorrelated signal 358. Furthermore, the combiner 364 is operative to calculate weighting factors for the weighted combination from the downmix information 354 and the target rendering information 360. The target rendering information indicates virtual positions of the audio objects in a virtual replay setup and indicates the specific placement of the audio objects in order to determine, whether a certain object is to be rendered in the first output channel or the second output channel, i.e., in a left output channel or a right output channel for a stereo rendering. When, however, a multi-channel rendering is performed, then the target rendering information additionally indicates whether a certain channel is to be placed more or less in a left surround or a right surround or center channel etc. Any rendering scenarios can be implemented, but will be different from each other due to the target rendering information in the form of the target rendering matrix, which is normally provided by the user and which will be discussed later on.

Finally, the combiner 364 uses the audio object parameter information 362 indicating energy information and correlation information describing the audio objects. In one embodiment, the audio object parameter information is given as an audio, object covariance matrix for each "tile" in the time/frequency plane. Stated differently, for each subband and for each time block, in which this subband is defined, a complete object covariance matrix, i.e., a matrix having power/energy information and correlation information is provided as the audio object parameter information 362.

When FIG. 3*b* and FIG. 2*a* or 2*b* are compared, it becomes clear that the audio object decoder 102 in FIG. 1 corresponds to the apparatus for synthesizing a rendered output signal.

Furthermore, the stereo processor 201 includes the decorrelator stage 356 of FIG. 3*b*. On the other hand, the combiner 364 includes the matrix calculator 202 in FIG. 2*a*. Furthermore, when the decorrelator stage 356 includes a decorrelator downmix operation, this portion of the matrix calculator 202 is included in the decorrelator stage 356 rather than in the combiner 364.

Nevertheless, any specific location of a certain function is not decisive here, since an implementation of the present invention in software or within a dedicated digital signal processor or even within a general purpose personal computer is in the scope of the present invention. Therefore, the attribution of a certain function to a certain block is one way of implementing the present invention in hardware. When, however, all block circuit diagrams are considered as flow charts for illustrating a certain flow of operational steps, it becomes clear that the contribution of certain functions to a certain block is freely possible and can be done depending on implementation or programming requirements.

Furthermore, when FIG. 3*b* is compared to FIG. 3*a*, it becomes clear that the functionality of the combiner 364 for calculating weighting factors for the weighted combination is included in the matrix calculator 202. Stated differently, the matrix information constitutes a collection of weighting factors which are applied to the enhanced matrix unit 303, which is implemented in the combiner 364, but which can also include the portion of the decorrelator stage 356 (with respect to matrix Q as will be discussed later on). Thus, the enhanced matrixing unit 303 performs the combination operation of subbands of the at least two object down mix signals, where the matrix information includes weighting factors for weighting these at least two down mix signals or the decorrelated signal before performing the combination operation.

Figure 4A:
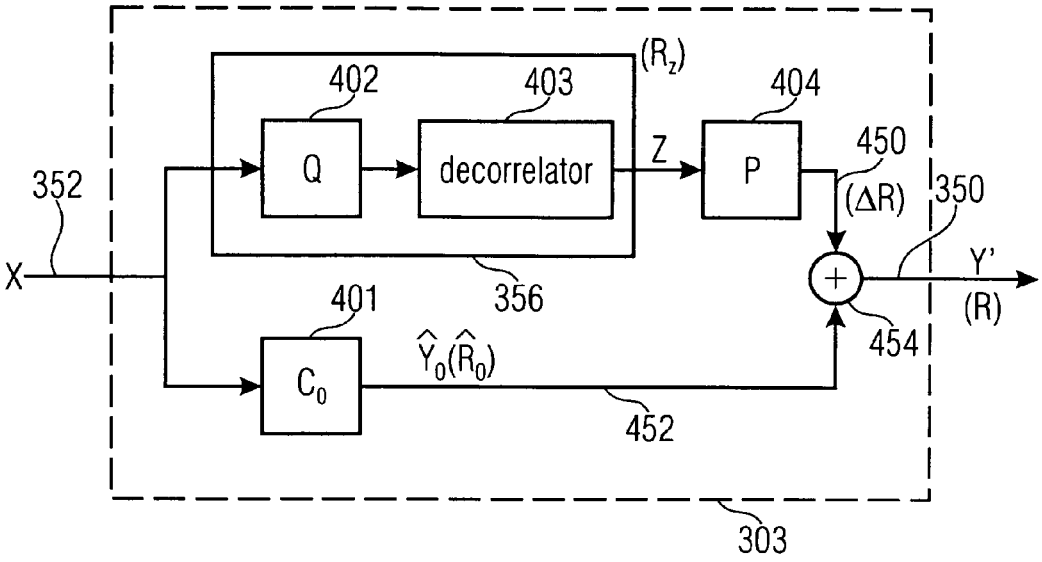
FIG. 4*a* is the first aspect of the invention including a dry signal mix matrix $C_0$, a pre-decorrelator mix matrix Q and a decorrelator upmix matrix P.
Figure 4B:
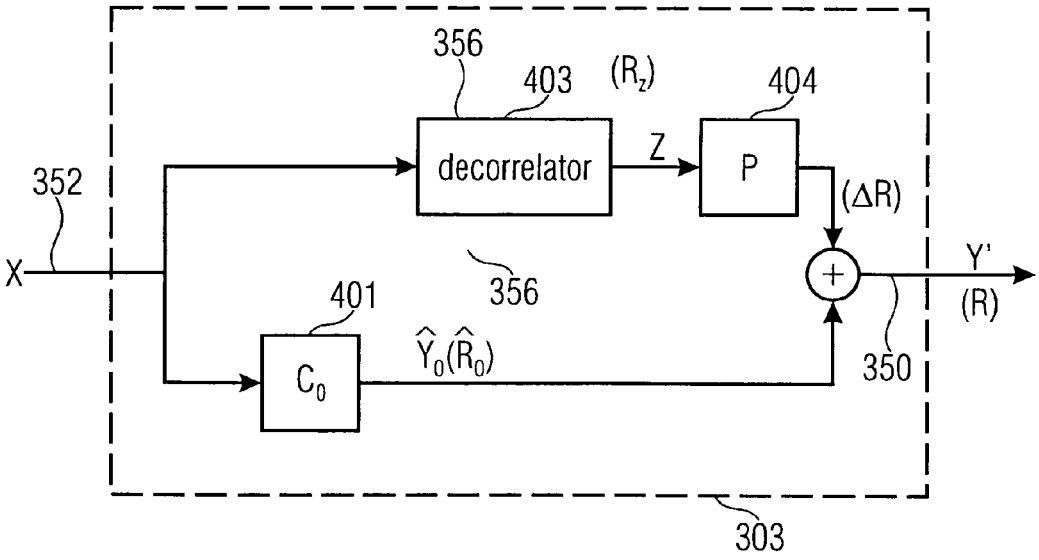
FIG. 4*b* is another aspect of the present invention which is implemented without a pre-decorrelator mix matrix.

Subsequently, the detailed structure of an embodiment of the combiner 364 and the decorrelator stage 356 are discussed. Specifically, several different implementations of the functionality of the decorrelator stage 356 and the combiner 364 are discussed with respect to FIGS. 4*a* to 4*d*. FIGS. 4*e* to FIG. 4*g* illustrate specific implementations of items in FIG. 4*a* to FIG. 4*d*. Before discussing FIG. 4*a* to FIG. 4*d* in detail, the general structure of these figures is discussed. Each figure includes an upper branch related to the decorrelated signal and a lower branch related to the dry signal. Furthermore, the output signal of each branch, i.e., a signal at line 450 and a signal at line 452 are combined in a combiner 454 in order to finally obtain the rendered output signal 350. Generally, the system in FIG. 4*a* illustrates three matrix processing units 401, 402, 404. 401 is the dry signal mix unit. The at least two object downmix signals 352 are weighted and/or mixed with each other to obtain two dry mix object signals which correspond the signals from the dry signal branch which is input into the adder 454. However, the dry signal branch may have another matrix processing unit, i.e., the gain compensation unit 409 in FIG. 4*d* which is connected downstream of the dry signal mix unit 401.

Furthermore, the combiner unit 364 may or may not include the decorrelator upmix unit 404 having the decorrelator upmix matrix P.

Naturally, the separation of the matrixing units 404, 401 and 409 (FIG. 4*d*) and the combiner unit 454 is only artificially true, although a corresponding implementation is, of course, possible. Alternatively, however, the functionalities of these matrices can be implemented via a single "big" matrix which receives, as an input, the decorrelated signal 358 and the downmix signal 352, and which outputs the two or three or more rendered output channels 350. In such a "big matrix" implementation, the signals at lines 450 and 452 may not necessarily occur, but the functionality of such a "big matrix" can be described in a sense that a result of an application of this matrix is represented by the different sub-operations performed by the matrixing units 404, 401 or 409 and a combiner unit 454, although the intermediate results 450 and 452 may never occur in an explicit way.

Furthermore, the decorrelator stage 356 can include the pre-decorrelator mix unit 402 or not. FIG. 4*b* illustrates a situation, in which this unit is not provided. This is specifically useful when two decorrelators for the two downmix channel signals are provided and a specific downmix is not needed. Naturally, one could apply certain gain factors to both downmix channels or one might mix the two downmix channels before they are input into a decorrelator stage depending on a specific implementation requirement. On the other hand, however, the functionality of matrix Q can also be included in a specific matrix P. This means that matrix P in FIG. 4*b* is different from matrix P in FIG. 4*a*, although the same result is obtained. In view of this, the decorrelator stage 356 may not include any matrix at all, and the complete matrix info calculation is performed in the combiner and the complete application of the matrices is performed in the combiner as well. However, for the purpose of better illustrating the technical functionalities behind these mathematics, the subsequent description of the present invention will be performed with respect to the specific and technically transparent matrix processing scheme illustrated in FIGS. 4*a* to 4*d*.

FIG. 4*a* illustrates the structure of the inventive enhanced matrixing unit 303. The input X comprising at least two channels is fed into the dry signal mix unit 401 which performs a matrix operation according to the dry mix matrix C and outputs the stereo dry upmix signal $\hat{Y}$. The input X is also fed into the pre-decorrelator mix unit 402 which performs a matrix operation according to the pre-decorrelator mix matrix Q and outputs an $N_d$ channel signal to be fed into the decorrelator unit 403. The resulting $N_d$ channel decorrelated signal Z is subsequently fed into the decorrelator upmix unit 404 which performs a matrix operation according to the decorrelator upmix matrix P and outputs a decorrelated stereo signal. Finally, the decorrelated stereo signal is mixed by simple channel-wise addition with the stereo dry upmix signal $\hat{Y}$ in order to form the output signal Y' of the enhanced matrixing unit. The three mix matrices (C,Q,P) are all described by the matrix info supplied to the stereo processor 201 by the matrix calculator 202. One conventional system would only contain the lower dry signal branch. Such a system would perform poorly in the simple case where a stereo music object is contained in one object downmix channel and a mono voice object is contained in the other object downmix channel. This is so because the rendering of the music to stereo would rely entirely on frequency selective panning although a parametric stereo approach including decorrelation is known to achieve much higher perceived audio quality. An entirely different conventional system including decorrelation but based on two separate mono object downmixes would perform better for this particular example, but would on the other hand reach the same quality as the first mentioned dry stereo system for a backwards compatible downmix case where the music is kept in true stereo and the voice is mixed with equal weights to the two object downmix channels. As an example consider the case of a Karaoke-type target rendering consisting of the stereo music object alone. A separate treatment of each of the downmix channels then allows for a less optimal suppression of the voice object than a joint treatment taking into account transmitted stereo audio object information such as inter-channel correlation. The crucial feature of the present invention is to enable the highest possible audio quality, not only in both of these simple situations, but also for much more complex combinations of object downmix and rendering.

FIG. 4*b* illustrates, as stated above, a situation where, in contrast to FIG. 4*a*, the pre-decorrelator mix matrix Q is not necessitated or is "absorbed" in the decorrelator upmix matrix P.

Figure 4C:
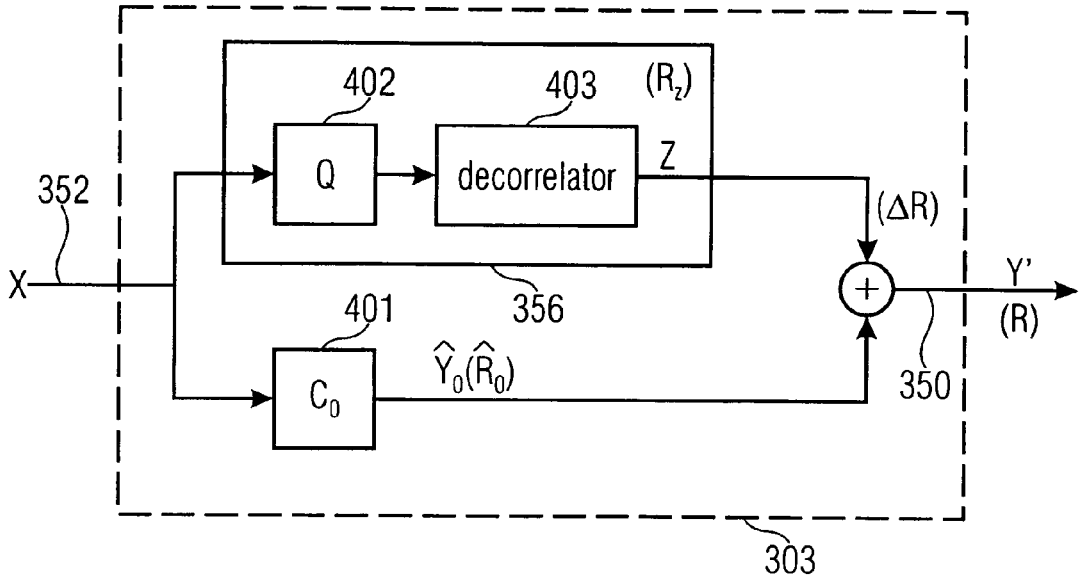
FIG. 4*c* is another aspect of the present invention which is implemented without the decorrelator upmix matrix.

FIG. 4*c* illustrates a situation, in which the predecorrelator matrix Q is provided and implemented in the decorrelator stage 356, and in which the decorrelator upmix matrix P is not necessitated or is "absorbed" in matrix Q.

Figure 4D:
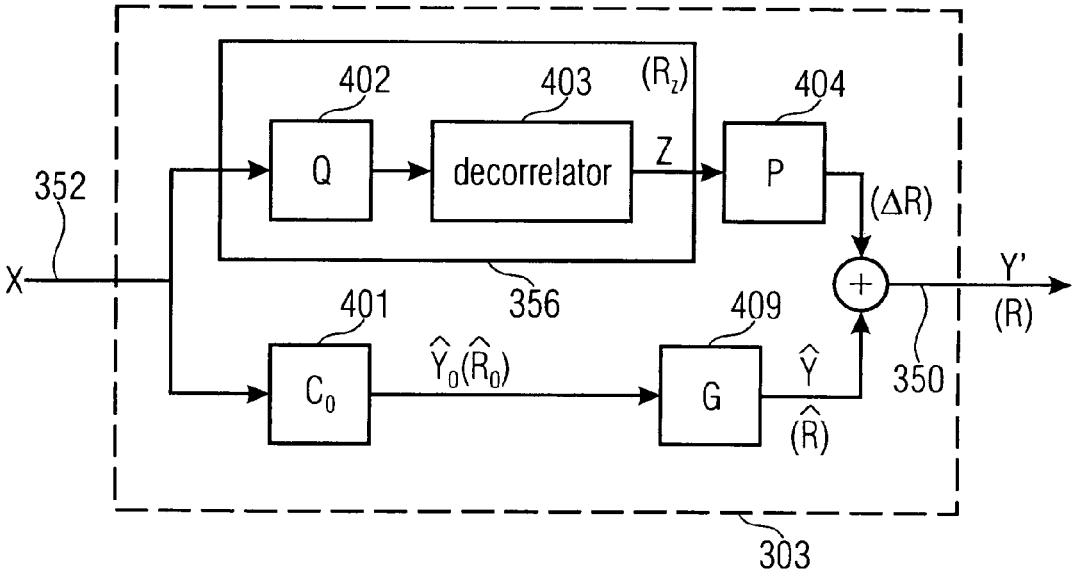
FIG. 4*d* is another aspect of the present of the present invention which is implemented with an additional gain compensation matrix G.
Figure 4E:
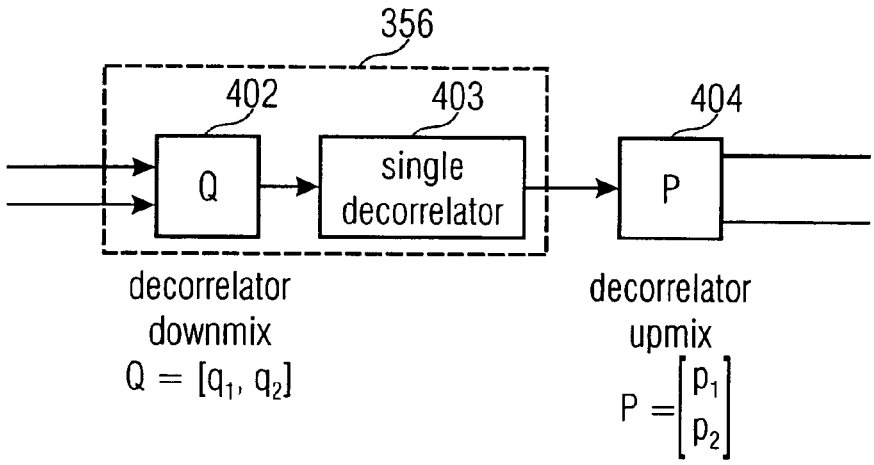
FIG. 4*e* is an implementation of the decorrelator downmix matrix Q and the decorrelator upmix matrix P when a single decorrelator is used.
Figure 4F:
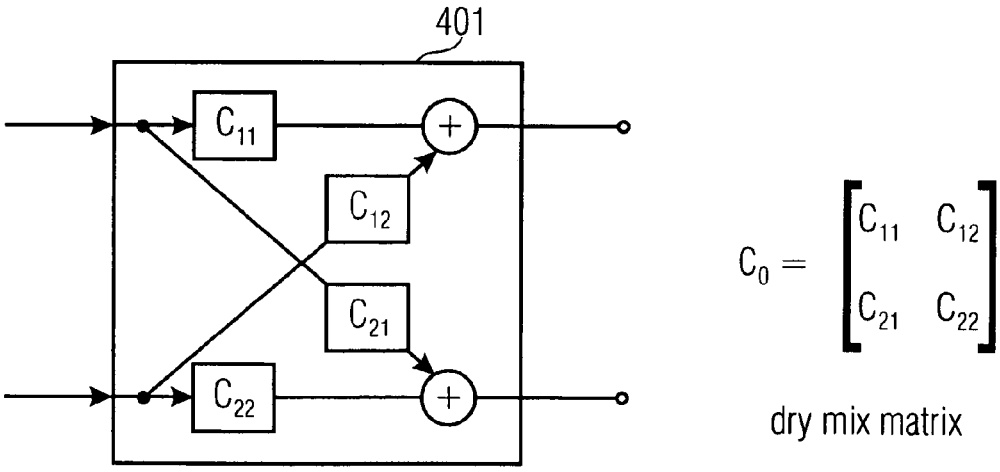
FIG. 4*f* is an implementation of the dry mix matrix $C_0$.
Figure 4G:
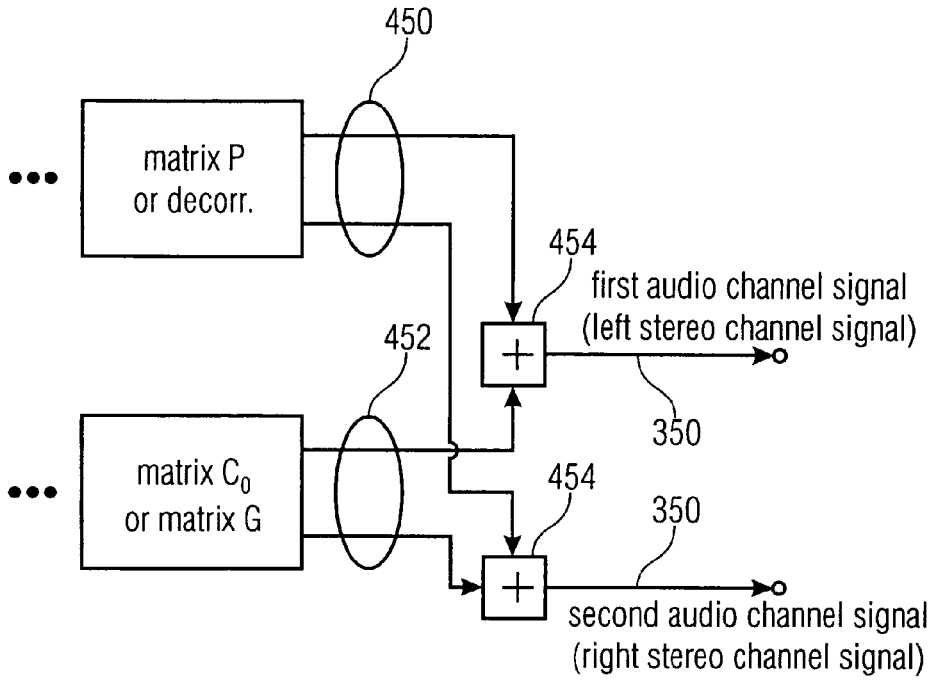
FIG. 4*g* is a detailed view of the actual combination of the result of the dry signal mix and the result of the decorrelator or decorrelator upmix operation.

Furthermore, FIG. 4*d* illustrates a situation, in which the same matrices as in FIG. 4*a* are present, but in which an additional gain compensation matrix G is provided which is specifically useful in the third embodiment to be discussed in connection with FIG. 13 and the fourth embodiment to be discussed in FIG. 14.

The decorrelator stage 356 may include a single decorrelator or two decorrelators. FIG. 4*e* illustrates a situation, in which a single decorrelator 403 is provided and in which the downmix signal is a two-channel object downmix signal, and the output signal is a two-channel audio output signal. In this case, the decorrelator downmix matrix Q has one line and two columns, and the decorrelator upmix matrix has one column and two lines. When, however, the downmix signal would have more than two channels, then the number of columns of Q would equal to the number of channels of the downmix signal, and when the synthesized rendered output signal would have more than two channels, then the decorrelator upmix matrix P would have a number of lines equal to the number of channels of the rendered output signal.

FIG. 4*f* illustrates a circuit-like implementation of the dry signal mix unit 401, which is indicated as $C_0$ and which has, in the two by two embodiment, two lines in two columns. The matrix elements are illustrated in the circuit-like structure as the weighting factors $c_{ij}$. Furthermore, the weighted channels are combined using adders as is visible from FIG. 4*f*. When, however, the number of downmix channels is different from the number of rendered output signal channels, then the dry mix matrix $C_0$ will not be a quadratic matrix but will have a number of lines which is different from the number of columns.

FIG. 4*g* illustrates in detail the functionality of adding stage 454 in FIG. 4*a*. Specifically, for the case of two output channels, such as the left stereo channel signal and the right stereo channel signal, two different adder stages 454 are provided, which combine output signals from the upper branch related to the decorrelator signal and the lower branch related to the dry signal as illustrated in FIG. 4*g*.

Regarding the gain compensation matrix G 409, the elements of the gain compensation matrix are only on the diagonal of matrix G. In the two by two case, which is illustrated in FIG. 4*f* for the dry signal mix matrix $C_0$, a gain factor for gain-compensating the left dry signal would be at the position of $c_{11}$, and a gain factor for gain-compensating the right dry signal would be at the position of $c_{22}$ of matrix $C_0$ in FIG. 4*f*. The values for $c_{12}$ and $c_{21}$ would be equal to 0 in the two by two gain matrix G as illustrated at 409 in FIG. 4*d*.

Figure 5:
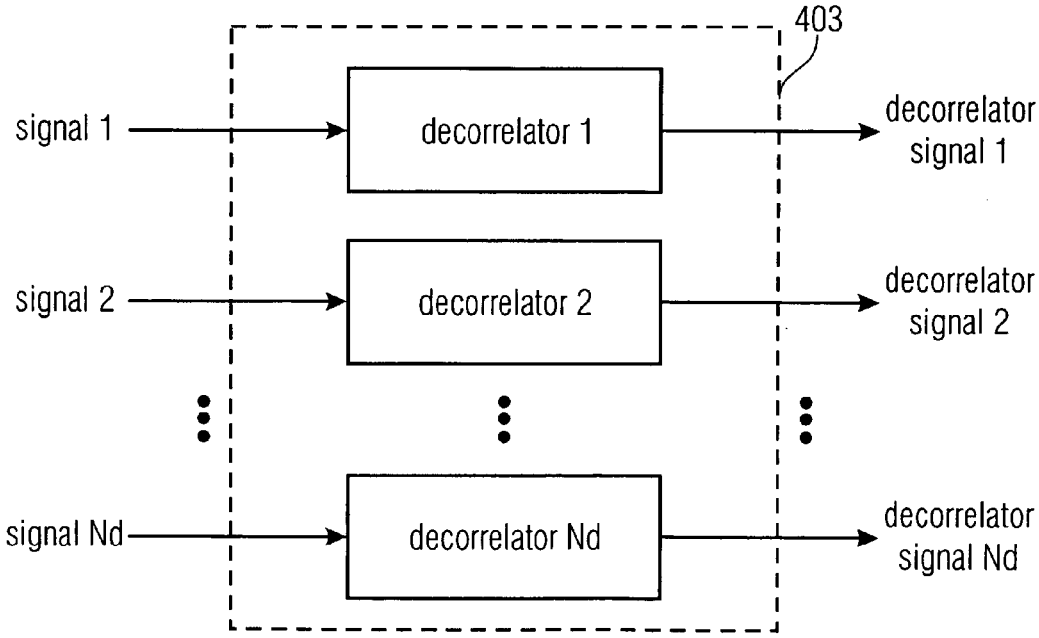
FIG. 5 is an operation of a multichannel decorrelator stage having many decorrelators.

FIG. 5 illustrates the conventional operation of a multi-channel decorrelator 403. Such a tool is used for instance in MPEG Surround. The $N_d$ signals, signal 1, signal 2, . . . , signal $N_d$ are separately fed into, decorrelator 1, decorrelator 2, . . . decorrelator $N_d$. Each decorrelator typically consists of a filter aiming at producing an output which is as uncorrelated as possible with the input, while maintaining the input signal power. Moreover, the different decorrelator filters are chosen such that the outputs decorrelator signal 1, decorrelator signal 2, . . . decorrelator signal $N_d$ are also as uncorrelated as possible in a pairwise sense. Since decorrelators are typically of high computational complexity compared to other parts of an audio object decoder, it is of interest to keep the number $N_d$ as small as possible.

The present invention offers solutions for $N_d$ equal to 1, 2 or more, but less than the number of audio objects. Specifically, the number of decorrelators is, in an embodiment, equal to the number of audio channel signals of the rendered output signal or even smaller than the number of audio channel signals of the rendered output signal 350.

In the following text, a mathematical description of the present invention will be outlined. All signals considered here are subband samples from a modulated filter bank or windowed FFT analysis of discrete time signals. It is understood that these subbands have to be transformed back to the discrete time domain by corresponding synthesis filter bank operations. A signal block of L samples represents the signal in a time and frequency interval which is a part of the perceptually motivated tiling of the time-frequency plane that is applied for the description of signal properties. In this setting, the given audio objects can be represented as N rows of length L in a matrix, $$S = \begin{bmatrix} s_1(0) & s_1(1) & \dots & s_1(L-1) \\ s_2(0) & s_2(1) & \dots & s_2(L-1) \\ \vdots & \vdots & & \vdots \\ s_N(0) & s_N(1) & \dots & s_N(L-1) \end{bmatrix}. \quad (1)$$

FIG. 6 illustrates an embodiment of an audio object map illustrating a number of N objects. In the exemplary explanation of FIG. 6, each object has an object ID, a corresponding object audio file and, importantly, audio object parameter information which is information relating to the energy of the audio object and to the inter-object correlation of the audio object. Specifically, the audio object parameter information includes an object co-variance matrix E for each subband and for each time block.

An example for such an object audio parameter information matrix E is illustrated in FIG. 7. The diagonal elements $e_{ii}$ include power or energy information of the audio object i in the corresponding subband and the corresponding time block. To this end, the subband signal representing a certain audio object i is input into a power or energy calculator which may, for example, perform an auto correlation function (acf) to obtain value $e_{11}$ with or without some normalization. Alternatively, the energy can be calculated as the sum of the squares of the signal over a certain length (i.e. the vector product: ss*). The acf can in some sense describe the spectral distribution of the energy, but due to the fact that a T/F-transform for frequency selection is used anyway, the energy calculation can be performed without an acf for each subband separately. Thus, the main diagonal elements of object audio parameter matrix E indicate a measure for the power of energy of an audio object in a certain subband in a certain time block.

On the other hand, the off-diagonal element $e_{ij}$ indicate a respective correlation measure between audio objects i, j in the corresponding subband and time block. It is clear from FIG. 7 that matrix E is—for real valued entries—symmetric with respect to the main diagonal. Generally, this matrix is a hermitian matrix. The correlation measure element $e_{ij}$ can be calculated, for example, by a cross correlation of the two subband signals of the respective audio objects so that a cross correlation measure is obtained which may or may not be normalized. Other correlation measures can be used which are not calculated using a cross correlation operation but which are calculate by other ways of determining correlation between two signals. For practical reasons, all elements of matrix E are normalized so that they have magnitudes between 0 and 1, where 1 indicates a maximum power or a maximum correlation and 0 indicates a minimum power (zero power) and −1 indicates a minimum correlation (out of phase).

The downmix matrix D of size K×N where K>1 determines the K channel downmix signal in the form of a matrix with K rows through the matrix multiplication $$X=DS. \tag{2}$$

FIG. 8 illustrates an example of a downmix matrix D having downmix matrix elements $d_{ij}$. Such an element $d_{ij}$ indicates whether a portion or the whole object j is included in the object downmix signal i or not. When, for example, $d_{12}$ is equal to zero, this means that object 2 is not included in the object downmix signal 1. On the other hand a value of $d_{23}$ equal to 1 indicates that object 3 is fully included in object downmix signal 2.

Values of downmix matrix elements between 0 and 1 are possible. Specifically, the value of 0.5 indicates that a certain object is included in a downmix signal, but only with half its energy. Thus, when an audio object such object number 4 is equally distributed to both downmix signal channels, then $d_{24}$ and $d_{14}$ would be equal to 0.5. This way of downmixing is an energy-conserving downmix operation which is advantageous for some situations. Alternatively, however, a non-energy conserving downmix can be used as well, in which the whole audio object is introduced into the left downmix channel and the right downmix channel so that the energy of this audio object has been doubled with respect to the other audio objects within the downmix signal.

At the lower portion of FIG. 8, a schematic diagram of the object encoder 101 of FIG. 1 is given. Specifically, the object encoder 101 includes two different portions 101*a* and 101*b*. Portion 101*a* is a downmixer which performs a weighted linear combination of audio objects 1, 2, . . . , N, and the second portion of the object encoder 101 is an audio object parameter calculator 101*b*, which calculates the audio object parameter information such as matrix E for each time block or subband in order to provide the audio energy and correlation information which is a parametric information and can, therefore, be transmitted with a low bit rate or can be stored consuming a small amount of memory resources.

The user controlled object rendering matrix A of size M×N determines the M channel target rendering of the audio objects in the form of a matrix with M rows through the matrix multiplication $$Y=AS. \tag{3}$$

It will be assumed throughout the following derivation that M=2 since the focus is on stereo rendering. Given an initial rendering matrix to more than two channels, and a downmix rule from those several channels into two channels it is obvious for those skilled in the art to derive the corresponding rendering matrix A of size 2×N for stereo rendering. This reduction is performed in the rendering reducer 204. It will also be assumed for simplicity that K=2 such that the object downmix is also a stereo signal. The case of a stereo object downmix is furthermore the most important special case in terms of application scenarios.

FIG. 9 illustrates a detailed explanation of the target rendering matrix A. Depending on the application, the target rendering matrix A can be provided by the user. The user has full freedom to indicate, where an audio object should be located in a virtual manner for a replay setup. The strength of the audio object concept is that the down-mix information and the audio object parameter information is completely independent on a specific localization of the audio objects. This localization of audio objects is provided by a user in the form of target rendering information. The target rendering information can be implemented as a target rendering matrix A which may be in the form of the matrix in FIG. 9. Specifically, the rendering matrix A has M lines and N columns, where M is equal to the number of channels in the rendered output signal, and wherein N is equal to the number of audio objects. M is equal to two of the stereo rendering scenario, but if an M-channel rendering is performed, then the matrix A has M lines.

Specifically, a matrix element $a_{ij}$, indicates whether a portion or the whole object j is to be rendered in the specific output channel i or not. The lower portion of FIG. 9 gives a simple example for the target rendering matrix of a scenario, in which there are six audio objects AO1 to AO6 wherein only the first five audio objects should be rendered at specific positions and that the sixth audio object should not be rendered at all.

Regarding audio object AO1, the user wants that this audio object is rendered at the left side of a replay scenario. Therefore, this object is placed at the position of a left speaker in a (virtual) replay room, which results in the first column of the rendering matrix A to be (10). Regarding the second audio object, $a_{22}$ is one and $a_{12}$ is 0 which means that the second audio object is to be rendered on the right side.

Audio object 3 is to be rendered in the middle between the left speaker and the right speaker so that 50% of the level or signal of this audio object go into the left channel and 50% of the level or signal go into the right channel so that the corresponding third column of the target rendering matrix A is (0.5 length 0.5).

Similarly, any placement between the left speaker and the right speaker can be indicated by the target rendering matrix. Regarding audio object 4, the placement is more to the right side, since the matrix element $a_{24}$ is larger than $a_{14}$. Similarly, the fifth audio object A05 is rendered to be more to the left speaker as indicated by the target rendering matrix elements $a_{15}$ and $a_{25}$. The target rendering matrix A additionally allows to not render a certain audio object at all. This is exemplarily illustrated by the sixth column of the target rendering matrix A which has zero elements.

It will be assumed throughout the following derivation that M=2 since the focus is on stereo rendering. Given an initial rendering matrix to more than two channels, and a downmix rule from those several channels into two channels it is obvious for those skilled in the art to derive the corresponding rendering matrix A of size 2×N for stereo rendering. This reduction is performed in the rendering reducer 204. It will also be assumed for simplicity that K=2 such that the object downmix is also a stereo signal. The case of a stereo object downmix is furthermore the most important special case in terms of application scenarios.

Disregarding for a moment the effects of lossy coding of the object downmix audio signal, the task of the audio object decoder is to generate an approximation in the perceptual sense of the target rendering Y of the original audio objects, given the rendering matrix A, the downmix X the downmix matrix D, and object parameters. The structure of the inventive enhanced matrixing unit 303 is given in FIG. 4. Given a number $N_d$ of mutually orthogonal decorrelators in 403, there are three mixing matrices.

C of size 2×2 performs the dry signal mix

Q of size $N_d$×2 performs the pre-decorrelator mix

P of size 2×$N_d$ performs the decorrelator upmix

Assuming the decorrelators are power preserving, the decorrelated signal matrix Z has a diagonal $N_d$×$N_d$ covariance matrix $R_z$=ZZ* whose diagonal values are equal to those of the covariance matrix $$QXX^*Q^* \tag{4}$$

of the pre-decorrelator mix processed object downmix. (Here and in the following, the star denotes the complex conjugate transpose matrix operation. It is also understood that the deterministic covariance matrices of the form UV* which are used throughout for computational convenience can be replaced by expectations E{UV*}.) Moreover, all the decorrelated signals can be assumed to be uncorrelated from the object downmix signals. Hence, the covariance R' of the combined output of the inventive enhanced matrixing unit 303, $$V=\hat{Y}+PZ=CX+PZ, \tag{5}$$

can be written as a sum of the covariance $\hat{R}=\hat{Y}\hat{Y}^*$ of the dry signal mix $\hat{Y}$=CX and the resulting decorrelator output covariance $$R'=\hat{R}+PR_ZP^*. \tag{6}$$

The object parameters typically carry information on object powers and selected inter-object correlations. From these parameters, a model E is achieved of the N×N object covariance SS*.

$$SS^*=E. \tag{7}$$

The data available to the audio object decoder is in this case described by the triplet of matrices (D,E,A), and the method taught by the present invention consists of using this data to jointly optimize the waveform match of the combined output (5) and its covariance (6) to the target rendering signal (4). For a given dry signal mix matrix, the problem at hand is to aim at the correct target covariance R'=R which can be estimated by $$R=YY^*=ASS^*A^*=AEA^*. \tag{8}$$

With the definition of the error matrix $$\Delta R=R-\hat{R}, \tag{9}$$

a comparison with (6) leads to the design requirement $$PR_ZP^*=\Delta R. \tag{10}$$

Since the left hand side of (10) is a positive semidefinite matrix for any choice of decorrelator mix matrix P, it is necessitated that the error matrix of (9) is a positive semidefinite matrix as well. In order to clarify the details of the subsequent formulas, let the covariances of the dry signal mix and the target rendering be parameterized as follows $$R=\begin{bmatrix} L & p \\ p & R \end{bmatrix}, \hat{R}=\begin{bmatrix} \hat{L} & \hat{p} \\ \hat{p} & \hat{R} \end{bmatrix}. \tag{11}$$

For the error matrix $$\Delta R=\begin{bmatrix} \Delta L & \Delta p \\ \Delta p & \Delta R \end{bmatrix}=\begin{bmatrix} L-\hat{L} & p-\hat{p} \\ p-\hat{p} & R-\hat{R} \end{bmatrix}, \tag{12}$$

the requirement to be positive semidefinite can be expressed as the three conditions $$\Delta L\geqq 0, \Delta R\geqq 0, \Delta L\Delta R-(\Delta p)^2\geqq 0. \tag{13}$$

Figure 10:
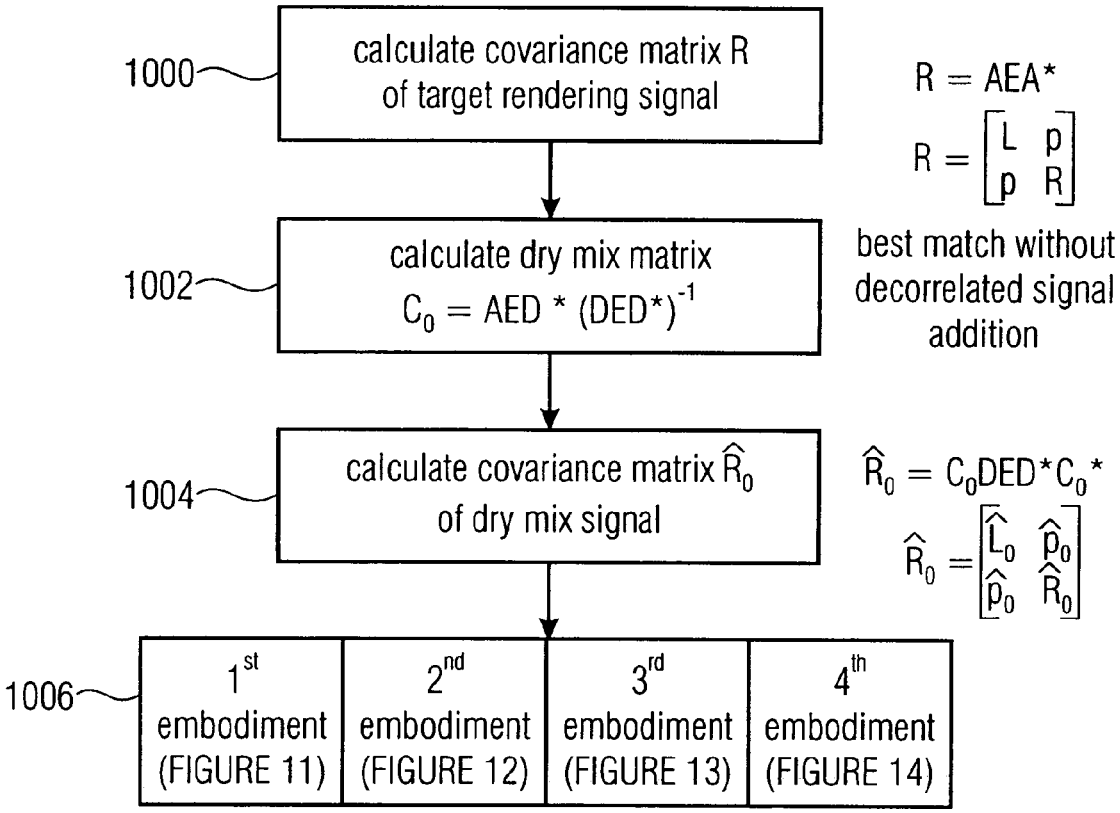
FIG. 10 is a collection of pre-calculation steps performed for determining the matrix elements of the matrices in FIGS. 4*a* to 4*d* in accordance with four different embodiments.

Subsequently, FIG. 10 is discussed. FIG. 10 illustrates a collection of some pre-calculating steps which are preformed for all four embodiments to be discussed in connection with FIGS. 11 to 14. One such pre-calculation step is the calculation of the covariance matrix R of the target rendering signal as indicated at 1000 in FIG. 10. Block 1000 corresponds to equation (8).

As indicated in block 1002, the dry mix matrix can be calculated using equation (15). Particularly, the dry mix matrix $C_0$ is calculated such that a best match of the target rendering signal is obtained by using the downmix signals, assuming that the decorrelated signal is not to be added at all. Thus, the dry mix matrix makes sure that a mix matrix output signal wave form matches the target rendering signal as close as possible without any additional decorrelated signal. This prerequisite for the dry mix matrix is particularly useful for keeping the portion of the decorrelated signal in the output channel as low as possible. Generally, the decorrelated signal is a signal which has been modified by the decorrelator to a large extent. Thus, this signal usually has artifacts such a colorization, time smearing and bad transient response. Therefore, this embodiment provides the advantage that less signal from the decorrelation process usually results in a better audio output quality. By performing a wave form matching, i.e., weighting and combining the two channels or more channels in the downmix signal so that these channels after the dry mix operation approach the target rendering signal as close as possible, only a minimum amount of decorrelated signal is needed.

The combiner 364 is operative to calculate the weighting factors so the result 452 of a mixing operation of the first object downmix signal and the second object downmix signal is wave form-matched to a target rendering result, which would as far as possible correspond to a situation which would be obtained, when rendering the original audio objects using the target rendering information 360 provided that the parametric audio object information 362 would be a loss less representation of the audio objects. Hence, exact reconstruction of the signal can never be guaranteed, even with an unquantized E matrix. One minimizes the error in a mean squared sense. Hence, one aims at getting a waveform match, and the powers and the cross-correlations are reconstructed.

As soon as the dry mix matrix $C_0$ is calculated e.g. in the above way, then the covariance matrix $\hat{R}_0$ of the dry mix signal can be calculated. Specifically, it is advantageous to use the equation written to the right of FIG. 10, i.e., $C_0DED^*C_0^*$. This calculation formula makes sure that, for the calculation of the covariance matrix $\hat{R}_0$ of the result of the dry signal mix, only parameters are necessitated, and subband samples are not necessitated. Alternatively, however, one could calculate the covariance matrix of the result of the dry signal mix using the dry mix matrix $C_0$ and the downmix signals as well, but the first calculation which takes place in the parameter domain only is of lower complexity.

Subsequent to the calculation steps 1000, 1002, 1004 the dry signal mix matrix $C_0$, the covariance matrix R of the target rendering signal and the covariance matrix $\hat{R}_0$ of the dry mix signal are available.

For the specific determination of matrices Q, P four different embodiments are subsequently described. Additionally, a situation of FIG. **4*d*** (for example for the third embodiment and the fourth embodiment) is described, in which the values of the gain compensation matrix G are determined as well Those skilled in the art will see that there exist other embodiments for calculating the values of these matrices, since there exists some degree of freedom for determining the necessitated matrix weighting factors.

In a first embodiment of the present invention, the operation of the matrix calculator 202 is designed as follows. The dry upmix matrix is first derived as to achieve the least squares solution to the signal waveform match $$\hat{Y}=CX\approx Y=AS, \tag{14}$$

In this context, it is noted that $\hat{Y}=C_0\cdot X=C_0\cdot D\cdot S$ is valid. Furthermore, the following equation holds true:

$$\hat{R}_0 = \hat{Y}_0\hat{Y}_0^* = C_0\cdot D\cdot S\cdot(C_0\cdot D\cdot S\cdot)^* = C_0\cdot D\cdot(S\cdot S^*)\cdot D^*\cdot C_0^* = C_0\cdot D\cdot E\cdot D^*\cdot C_0^*$$

The solution to this problem is given by $$C\approx C_0=AED^*(DED^*)^{-1} \tag{15}$$

and it has the additional well known property of least squares solutions, which can also easily be verified from (13) that the error $\Delta Y=Y-\hat{Y}_0=AS-C_0X$ is orthogonal to the approximation $\hat{Y}=C_0X$. Therefore, the cross terms vanish in the following computation, $$\begin{aligned} R = YY^* &= (\hat{Y}_0+\Delta Y)(\hat{Y}_0+\Delta Y)^* \\ &= Y_0Y_0^* + (\Delta Y)(\Delta Y)^* \\ &= \hat{R}_0 + (\Delta Y)(\Delta Y)^* \end{aligned} \tag{16}$$

It follows that $$\Delta R=(\Delta Y)(\Delta Y)^*, \tag{17}$$

which is trivially positive semi definite such that (10) can be solved. In a symbolic way the solution is $$P=TR_Z^{-1/2}, \tag{18}$$

Here the second factor $R_Z^{-1/2}$ is simply defined by the element-wise operation on the diagonal, and the matrix T solves the matrix equation $TT^*=\Delta R$. There is a large freedom in the choice of solution to this matrix equation. The method taught by the present invention is to start from the singular value decomposition of ΔR. For this symmetric matrix it reduces to the usual eigenvector decomposition, $$\Delta R = U\begin{bmatrix}\lambda_{max} & 0\\ 0 & \lambda_{min}\end{bmatrix}U^*;\ U=\begin{bmatrix}u_1 & u_2\\ u_2 & -u_1\end{bmatrix}, \tag{19}$$

where the eigenvector matrix U is unitary and its columns contain the eigenvectors corresponding to the eigenvalues sorted in decreasing size $\lambda_{max}\geqq\lambda_{min}\geqq 0$. The first solution with one decorrelator ($N_d=1$) taught by the present invention is obtained by setting $\lambda_{min}=0$ in (19), and inserting the corresponding natural approximation $$T\approx\begin{bmatrix}u_1\sqrt{\lambda_{max}}\\ u_2\sqrt{\lambda_{max}}\end{bmatrix} \tag{20}$$

in (18). The full solution with $N_d=2$ decorrelators is obtained by adding the missing least significant contribution from the smallest eigenvalue $\lambda_{min}$ of ΔR and adding a second column to (20) corresponding to a product of the first factor U of (19) and the element wise square root of the diagonal eigenvalue matrix. Written out in detail this amounts to $$T=\begin{bmatrix}u_1\sqrt{\lambda_{max}} & u_2\sqrt{\lambda_{min}}\\ u_2\sqrt{\lambda_{max}} & -u_1\sqrt{\lambda_{min}}\end{bmatrix}. \tag{21}$$

Subsequently, the calculation of matrix P in accordance with the first embodiment is summarized in connection with FIG. 11. In step 1101, the covariance matrix ΔR of the error signal or, when FIG. **4*a* is considered, that the correlated signal at the upper branch is calculated by using the results of step 1000 and step 1004 of FIG. 10**. Then, an eigenvalue decomposition of this matrix is performed which has been discussed in connection with equation (19). Then, matrix Q is chosen in accordance with one of a plurality of available strategies which will be discussed later on.

Figure 11:
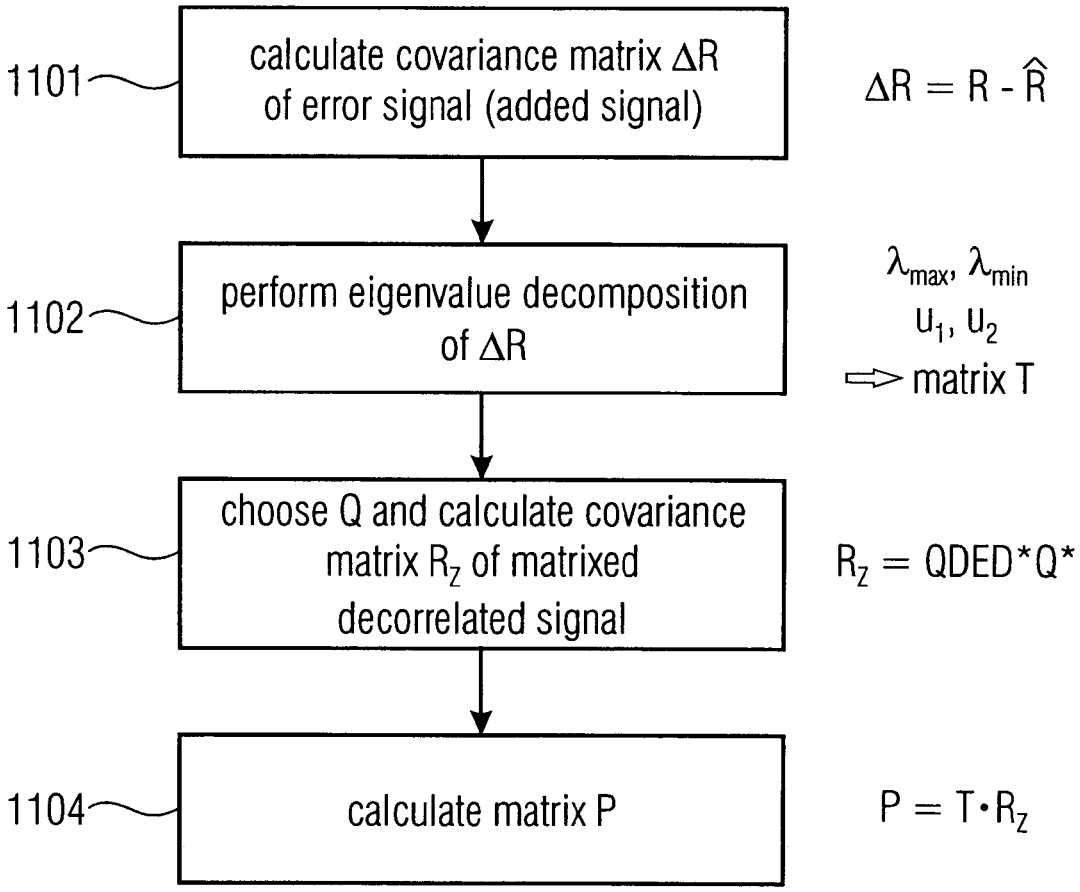
FIG. 11 is a collection of calculation steps in accordance with the first embodiment.

Based on the chosen matrix Q, the covariance matrix $R_z$ of the matrixed decorrelated signal is calculated using the equation written to the right of box 1103 in FIG. 11, i.e., the matrix multiplication of QDED*Q*. Then, based on $R_z$ as obtained in step 1103, the decorrelator upmix matrix P is calculated. It is clear that this matrix does not necessarily have to perform an actual upmix saying that at the output of block P 404 in FIG. **4*a* are more channel signals than at the input. This can be done in the case of a single correlator, but in the case of two decorrelators, the decorrelator upmix matrix P receives two input channels and outputs two output channels and may be implemented as the dry upmixer matrix illustrated in FIG. 4*f***.

Thus, the first embodiment is unique in that $C_0$ and P are calculated. It is referred that, in order to guarantee the correct resulting correlation structure of the output, one needs two decorrelators. On the other hand, it is an advantage to be able to use only one decorrelator. This solution is indicated by equation (20). Specifically, the decorrelator having the smaller eigenvalue is implemented.

In a second embodiment of the present invention the operation of the matrix calculator 202 is designed as follows. The decorrelator mix matrix is restricted to be of the form $$P = c\begin{bmatrix} 1 \\ -1 \end{bmatrix}. \tag{22}$$

With this restriction the single decorrelated signal covariance matrix is a scalar $R_Z=r_Z$ and the covariance of the combined output (6) becomes $$R' = \hat{R} + PR_ZP^* = \begin{bmatrix} \hat{L} & \hat{p} \\ \hat{p} & \hat{R} \end{bmatrix} + \alpha\begin{bmatrix} 1 & -1 \\ -1 & 1 \end{bmatrix}, \tag{23}$$

where $\alpha=c^2r_Z$. A full match to the target covariance R'=R is impossible in general, but the perceptually important normalized correlation between the output channels can be adjusted to that of the target in a large range of situations. Here, the target correlation is defined by $$\rho = \frac{p}{\sqrt{LR}}, \tag{24}$$

and the correlation achieved by the combined output (23) is given by $$\rho' = \frac{\hat{p} - \alpha}{\sqrt{(\hat{L} + \alpha)(\hat{R} + \alpha)}}. \tag{25}$$

Equating (24) and (25) leads to a quadratic equation in $\alpha$, $$p^2(\hat{L}+\alpha)(\hat{R}+\alpha)=(\hat{p}-\alpha)^2. \tag{26}$$

For the cases where (26) has a positive solution $\alpha=\alpha_0>0$, the second embodiment of the present invention teaches to use the constant $c=\sqrt{\alpha_0/r_Z}$ in the mix matrix definition (22). If both solutions of (26) are positive, the one yielding a smaller norm of c is to be used. In the case where no such solution exists, the decorrelator contribution is set to zero by choosing c=0, since complex solutions of c lead to perceptible phase distortions in the decorrelated signals. The computation of $\hat{p}$ can be implemented in two different ways, either directly from the signal $\hat{Y}$ or incorporating the object covariance matrix in combination with the down-mix and rendering information, as $\hat{R}=CDED^*C^*$. Here the first method will result in a complex-valued $\hat{p}$ and therefore, at the right-hand side of (26) the square must be taken from the real part or magnitude of $(\hat{p}-\alpha)$, respectively. Alternatively, however, even a complex valued $\hat{p}$ can be used. Such a complex value indicates a correlation with a specific phase term which is also useful for specific embodiments.

A feature of this embodiment, as it can be seen from (25), is that it can only decrease the correlation compared to that of the dry mix. That is, $\rho'\leqq\hat{\rho}=\hat{p}/\sqrt{\hat{L}\hat{R}}$.

Figure 12:
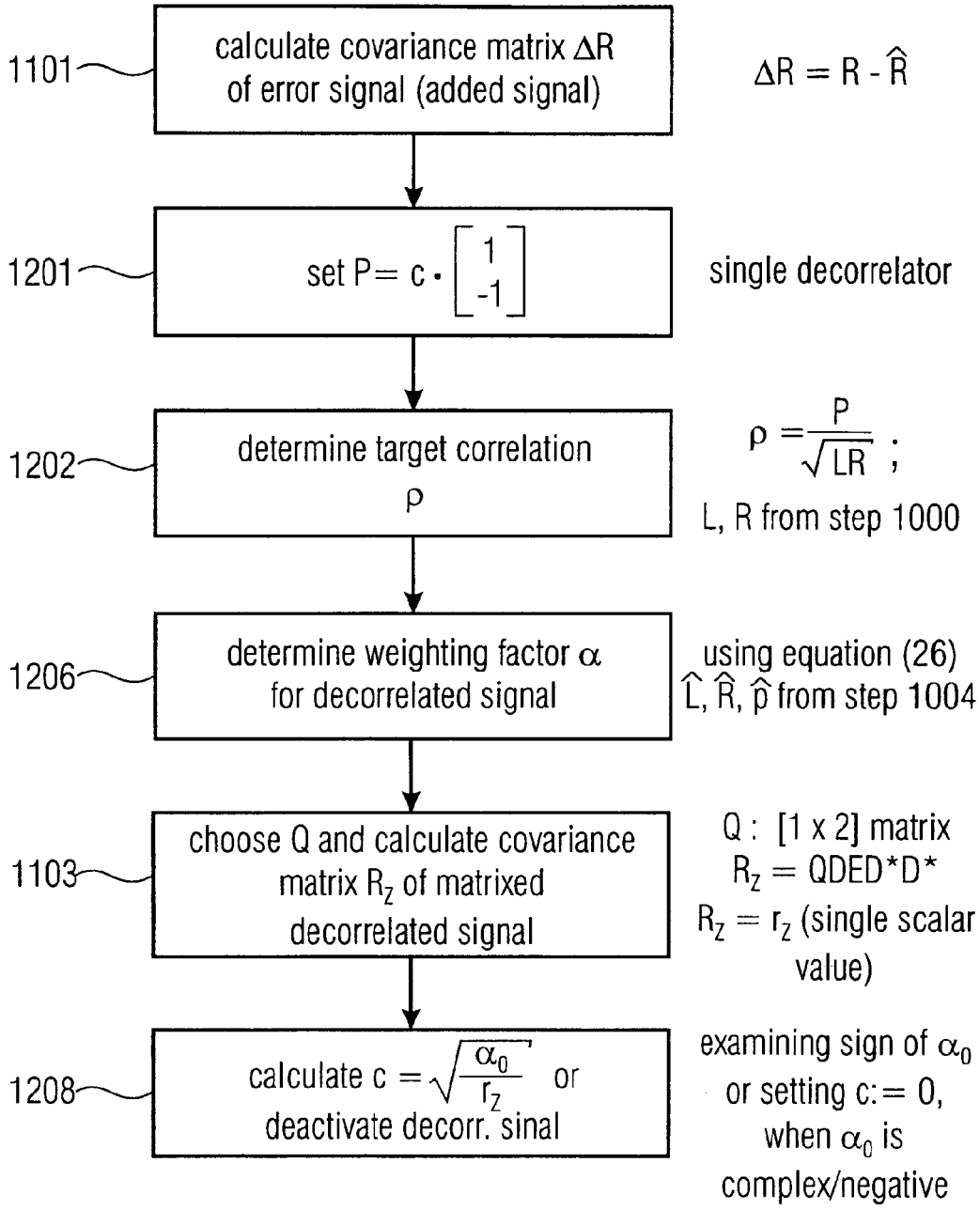
FIG. 12 is a collection of calculation steps in accordance with the second embodiment.

To summarize, the second embodiment is illustrated as shown in FIG. 12. It starts with the calculation of the covariance matrix $\Delta R$ in step 1101, which is identical to step 1101 in FIG. 11. Then, equation (22) is implemented. Specifically, the appearance of matrix P is pre-set and only the weighting factor c which is identical for both elements of P is open to be calculated. Specifically, a matrix P having a single column indicates that only a single decorrelator is used in this second embodiment. Furthermore, the signs of the elements of p make clear that the decorrelated signal is added to one channel such as the left channel of the dry mix signal and is subtracted from the right channel of the dry mix signal. Thus, a maximum decorrelation is obtained by adding the decorrelated signal to one channel and subtracting the decorrelated signal from the other channel. In order to determine value c, steps 1203, 1206, 1103, and 1208 are performed. Specifically, the target correlation row as indicated in equation (24) is calculated in step 1203. This value is the interchannel cross-correlation value between the two audio channel signals when a stereo rendering is performed. Based on the result of step 1203, the weighting factor $\alpha$ is determined as indicated in step 1206 based on equation (26). Furthermore, the values for the matrix elements of matrix Q are chosen and the covariance matrix, which is in this case only a scalar value $R_z$ is calculated as indicated in step 1103 and as illustrated by the equation to the right of box 1103 in FIG. 12. Finally, the factor c is calculated as indicated in step 1208. Equation (26) is a quadratic equation which can provide two positive solutions to $\alpha$. In this case, as stated before, the solution yielding is smaller norm of c is to be used. When, however, no such positive solution is obtained, c is set to 0.

Thus, in the second embodiment, one calculates P using a special case of one decorrelator distribution for the two channels indicated by matrix P in box 1201. For some cases, the solution does not exist and one simply shuts off the decorrelator. An advantage of this embodiment is that it never adds a synthetic signal with positive correlation. This is beneficial, since such a signal could be perceived as a localised phantom source which is an artefact decreasing the audio quality of the rendered output signal. In view of the fact that power issues are not considered in the derivation, one could get a mismatch in the output signal which means that the output signal has more or less power that the downmix signal. In this case, one could implement an additional gain compensation in an embodiment in order to further enhance audio quality.

In a third embodiment of the present invention the operation of the matrix calculator 202 is designed as follows. The starting point is a gain compensated dry mix $$\hat{Y} = \begin{bmatrix} g_1 & 0 \\ 0 & g_2 \end{bmatrix}\hat{Y}_0, \tag{27}$$

where, for instance, the uncompensated dry mix $\hat{Y}_0$ is the result of the least squares approximation $\hat{Y}_0=C_0X$ with the mix matrix given by (15). Furthermore, $C=GC_0$, where G is a diagonal matrix with entries $g_1$ and $g_2$. In this case $$\hat{R} = \begin{bmatrix} \hat{L} & \hat{p} \\ \hat{p} & \hat{R} \end{bmatrix} = \begin{bmatrix} g_1 & 0 \\ 0 & g_2 \end{bmatrix} \cdot \begin{bmatrix} \hat{L}_0 & \hat{p}_0 \\ \hat{p}_0 & \hat{R}_0 \end{bmatrix} \cdot \begin{bmatrix} g_1 & 0 \\ 0 & g_2 \end{bmatrix} \tag{28}$$

$$= \begin{bmatrix} g_1^2\hat{L}_0 & g_1g_2\hat{p}_0 \\ g_1g_2\hat{p}_0 & g_2^2\hat{R}_0 \end{bmatrix},$$

and the error matrix is $$\Delta R = \begin{bmatrix} \Delta L & \Delta p \\ \Delta p & \Delta R \end{bmatrix} = \begin{bmatrix} L - g_1^2 \hat{L}_0 & p - g_1 g_2 \hat{p}_0 \\ p - g_1 g_2 \hat{p}_0 & R - g_2^2 \hat{R}_0 \end{bmatrix}, \tag{29}$$

It is then taught by the third embodiment of the present invention to choose the compensation gains ($g_1$,$g_2$) so as to minimize a weighted sum of the error powers $$w_1 \Delta L + w_2 \Delta R = w_1 (L - g_1^2 \hat{L}_0) + w_2 (R - g_2^2 \hat{R}_0), \tag{30}$$

under the constrains given by (13). Example choices of weights in (30) are ($w_1$,$w_2$)=(1,1) or ($w_1$,$w_2$)=(R,L). The resulting error matrix ΔR is then used as input to the computation of the decorrelator mix matrix P according to the steps of equations (18)-(21) An attractive feature of this embodiment is that in cases where error signal $Y-\hat{Y}_0$ is similar to the dry upmix, the amount of decorrelated signal added to the final output is smaller than that added to the final output by the first embodiment of the present invention.

Figure 13:
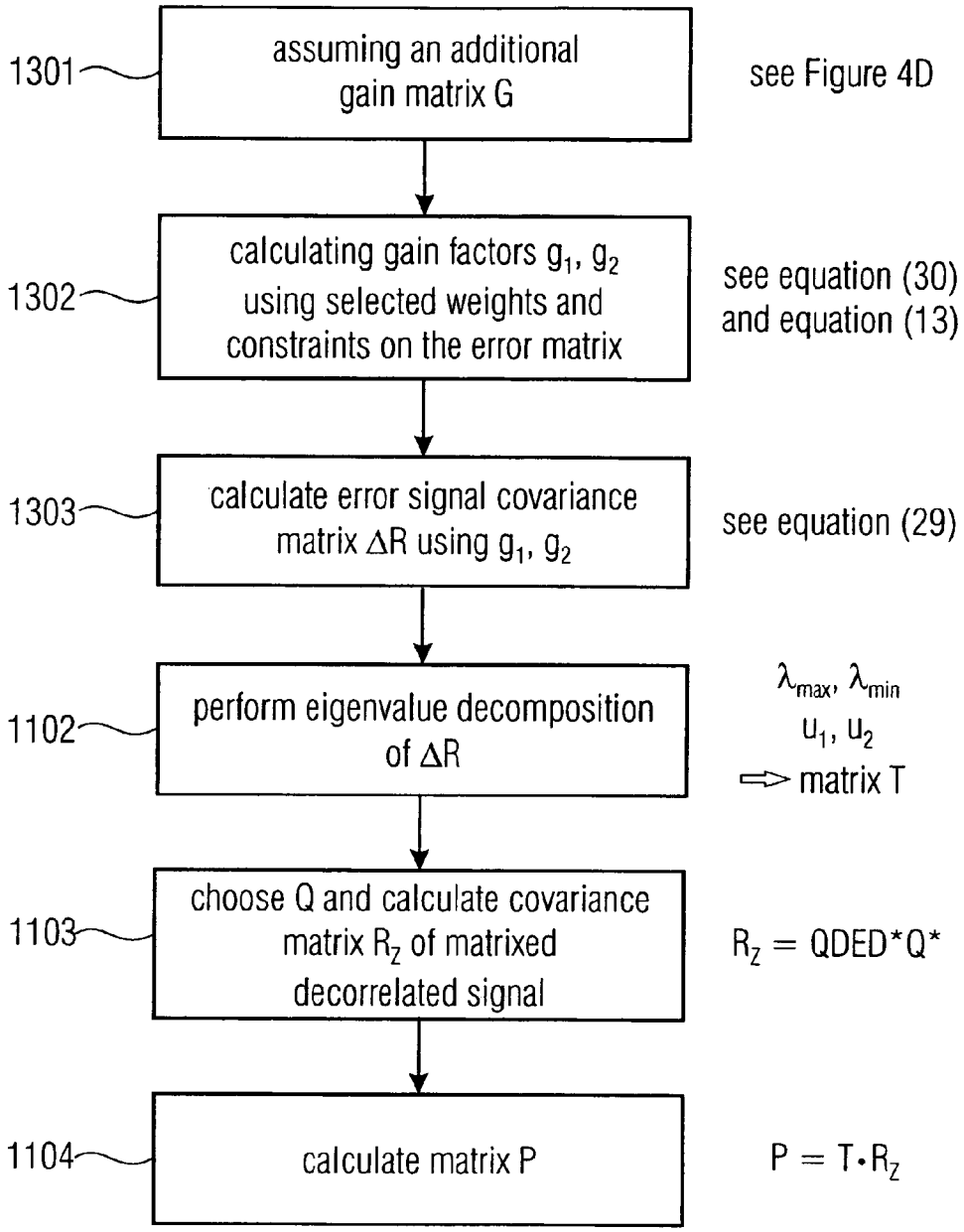
FIG. 13 is a collection of calculation steps in accordance with the third embodiment.
Figure 14:
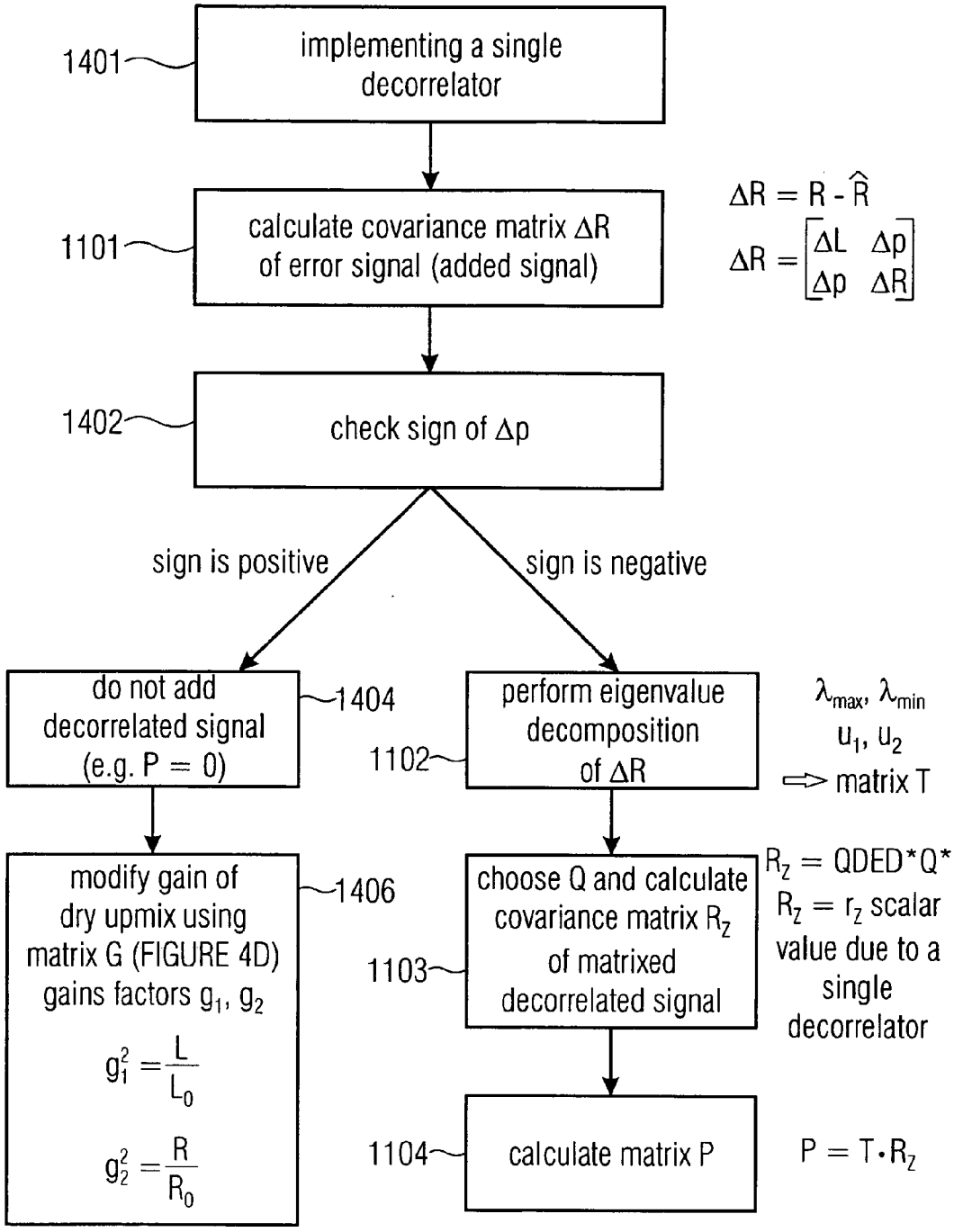
FIG. 14 is a collection of calculation steps in accordance with the fourth embodiment.

In the third embodiment, which is summarized in connection with FIG. 13, an additional gain matrix G is assumed as indicated in FIG. 4*d*. In accordance with what is written in equation (29) and (30), gain factors $g_1$ and $g_2$ are calculated using selected w1, w2 as indicated in the text below equation (30) and based on the constraints on the error matrix as indicated in equation (13). After performing these two steps 1301, 1302, one can calculate an error signal covariance matrix ΔR using $g_1$, $g_2$ as indicated in step 1303. It is noted that this error signal covariance matrix calculated in step 1303 is different from the covariance matrix R as calculated in steps 1101 in FIG. 11 and FIG. 12. Then, the same steps 1102, 1103, 1104 are performed as have already been discussed in connection with the first embodiment of FIG. 11.

The third embodiment is advantageous in that the dry mix is not only wave form-matched but, in addition, gain compensated. This helps to further reduce the amount of decorrelated signal so that any artefacts incurred by adding the decorrelated signal are reduced as well. Thus, the third embodiment attempts to get the best possible from a combination of gain compensation and decorrelator addition. Again, the aim is to fully reproduce the covariance structure including channel powers and to use as little as possible of the synthetic signal such as by minimising equation (30).

Subsequently, a fourth embodiment is discussed. In step 1401, the single decorrelator is implemented. Thus, a low complexity embodiment is created since a single decorrelator is, for a practical implementation, most advantageous. In the subsequent step 1101, the covariance matrix data R is calculated as outlined and discussed in connection with step 1101 of the first embodiment. Alternatively, however, the covariance matrix data R can also be calculated as indicated in step 1303 of FIG. 13, where there is the gain compensation in addition to the wave form matching. Subsequently, the sign of Δp which is the off-diagonal element of the covariance matrix ΔR is checked. When step 1402 determines that this sign is negative, then steps 1102, 1103, 1104 of the first embodiment are processed, where step 1103 is particularly non-complex due to the fact that $r_z$ is a scalar value, since there is only a single decorrelator.

When, however, it is determined that the sign of Δp is positive, an addition of the decorrelated signal is completely eliminated such as by setting to zero, the elements of matrix P. Alternatively, the addition of a decorrelated signal can be reduced to a value above zero but to a value smaller than a value which would be there should the sign be negative. However, the matrix elements of matrix P are not only set to smaller values but are set to zero as indicated in block 1404 in FIG. 14. In accordance with FIG. 4*d*, however, gain factors $g_1$, $g_2$ are determined in order to perform a gain compensation as indicated in block 1406. Specifically, the gain factors are calculated such that the main diagonal elements of the matrix at the right side of equation (29) become zero. This means that the covariance matrix of the error signal has zero elements at its main diagonal. Thus, a gain compensation is achieved in the case, when the decorrelator signal is reduced or completely switched off due to the strategy for avoiding phantom source artefacts which might occur when a decorrelated signal having specific correlation properties is added.

Thus, the fourth embodiment combines some features of the first embodiment and relies on a single decorrelator solution, but includes a test for determining the quality of the decorrelated signal so that the decorrelated signal can be reduced or completely eliminated, when a quality indicator such as the value Δp in the covariance matrix ΔR of the error signal (added signal) becomes positive.

The choice of pre-decorrelator matrix Q should be based on perceptual considerations, since the second order theory above is insensitive to the specific matrix used. This implies also that the considerations leading to a choice of Q are independent of the selection between each of the aforementioned embodiments.

A first solution taught by the present invention consists of using the mono downmix of the dry stereo mix as input to all decorrelators. In terms of matrix elements this means that $$q_{n,k} = c_{i,k} + c_{2,k},\ k=1, 2;\ n=1, 2, \ldots, N_d, \tag{31}$$

where $\{q_{n,k}\}$ are the matrix elements of Q and $\{c_{n,k}\}$ are the matrix elements of $C_0$.

A second solution taught by the present invention leads to a pre-decorrelator matrix Q derived from the downmix matrix D alone. The derivation is based on the assumption that all objects have unit power and are uncorrelated. An upmix matrix from the objects to their individual prediction errors is formed given that assumption. Then the square of the pre-decorrelator weights are chosen in proportion to total predicted object error energy across down-mix channels. The same weights are finally used for all decorrelators. In detail, these weights are obtained by first forming the N×N matrix, $$W = I - D^*(DD^*)^{-1}D, \tag{32}$$

and then deriving an estimated object prediction error energy matrix $W_0$ defined by setting all off-diagonal values of (32) to zero. Denoting the diagonal values of $DW_0D^*$ by $t_1$,$t_2$, which represent the total object error energy contributions to each downmix channel, the final choice of predecorrelator matrix elements is given by $$q_{n,k} = \sqrt{\frac{t_k}{t_1 + t_2}},\ k = 1, 2;\ n = 1, 2, \ldots, N_d, \tag{33}$$

Regarding a specific implementation of the decorrelators, all decorrelators such as reverberators or any other decorrelators can be used. In an embodiment, however, the decorrelators should be power-conserving. This means that the power of the decorrelator output signal should be the same as the power of the decorrelator input signal. Nevertheless, deviations incurred by a non-power-conserving decorrelator can also be absorbed, for example by taking this into account when matrix P is calculated.

As stated before, embodiments try to avoid adding a synthetic signal with positive correlation, since such a signal could be perceived as a localised synthetic phantom source. In the second embodiment, this is explicitly avoided due to the specific structure of matrix P as indicated in block 1201. Furthermore, this problem is explicitly circumvented in the fourth embodiment due to the checking operation in step 1402. Other ways of determining the quality of the decorrelated signal and, specifically, the correlation characteristics so that such phantom source artefacts can be avoided are available for those skilled in the art and can be used for switching off the addition of the decorrelated signal as in the form of some embodiments or can be used for reducing the power of the decorrelated signal and increasing the power of the dry signal, in order to have a gain compensated output signal.

Although all matrices E, D, A have been described as complex matrices, these matrices can also be real-valued. Nevertheless, the present invention is also useful in connection with complex matrices D, A, E actually having complex coefficients with an imaginary part different from zero.

Furthermore, it will be often the case that the matrix D and the matrix A have a much lower spectral and time resolution compared to the matrix E which has the highest time and frequency resolution of all matrices. Specifically, the target rendering matrix and the downmix matrix will not depend on the frequency, but may depend on time. With respect to the downmix matrix, this might occur in a specific optimised downmix operation. Regarding the target rendering matrix, this might be the case in connection with moving audio objects which can change their position between left and right from time to time.

The below-described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

Depending on certain implementation requirements of the inventive methods, the inventive methods can be implemented in hardware or in software. The implementation can be performed using a digital storage medium, in particular, a disc, a DVD or a CD having electronically-readable control signals stored thereon, which co-operate with programmable computer systems such that the inventive methods are performed. Generally, the present invention is therefore a computer program product with a program code stored on a machine-readable carrier, the program code being operated for performing the inventive methods when the computer program product runs on a computer. In other words, the inventive methods are, therefore, a computer program having a program code for performing at least one of the inventive methods when the computer program runs on a computer.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Apparatus for synthesising an output signal comprising a first audio channel signal and a second audio channel signal, the apparatus comprising;

a decorrelator stage for generating a decorrelated signal comprising a decorrelated single channel signal or a decorrelated first channel signal and a decorrelated second channel signal from a downmix signal, the downmix signal comprising a first audio object downmix signal and a second audio object downmix signal, the downmix signal representing a downmix of a plurality of audio object signals in accordance with downmix information; and a combiner for performing a weighted combination of the downmix signal and the decorrelated signal using weighting factors, wherein the combiner is operative to calculate the weighting factors for the weighted combination from the downmix information, from target rendering information indicating virtual positions of the audio objects in a virtual replay set-up, and parametric audio object information describing the audio objects, wherein the combiner is operative to calculate a mixing matrix $C_0$ for mixing the first audio object downmix signal and the second audio object downmix signal based on the following equation:

$$C_0=AED^*(DED^*)^{-1},$$

wherein $C_0$ is the mixing matrix, wherein A is a target rendering matrix representing the target rendering information, wherein D is a downmix matrix representing the downmix information, wherein * represents a complex conjugate transpose operation, and wherein E is an audio object covariance matrix representing the parametric audio object information, and wherein at least one of the decorrelator stage or the combiner comprises a hardware implementation.

2. Apparatus in accordance with claim 1, in which the combiner is operative to calculate the weighting factors for the weighted combination so that a result of a mixing operation of the first audio object downmix signal and the second audio object downmix signal is wave form-matched to a target rendering result.

3. Apparatus in accordance with claim 1, in which the combiner is operative to calculate the weighting factors based on the following equation:

$$R=AEA^*,$$

wherein R is a covariance matrix of the rendered output signal acquired by applying the target rendering information to the audio objects, wherein A is a target rendering matrix representing the target rendering information, and wherein E is an audio object covariance matrix representing the parametric audio object information.

4. Apparatus in accordance with claim 1, wherein the combiner is operative to calculate the weighting factors based on the following equation:

$$R_0=C_0DED^*C_0^*,$$

wherein $R_0$ is a covariance matrix of the result of the mixing operation of the downmix signal.

5. Apparatus in accordance with claim 1, in which the combiner is operative to calculate the weighting factors for the weighted combination so that the weighted combination is acquirable, by calculating a dry signal mix matrix $C_0$ and applying the dry signal mix matrix $C_0$ to the downmix signal, by calculating a decorrelator post-processing matrix P and applying the decorrelator post-processing matrix P to the decorrelated signal, and by combining results of the applying operations to acquire the rendered output signal.

6. Apparatus in accordance with claim 5, in which the decorrelator post-processing matrix P is based on performing an eigenvalue decomposition of a covariance matrix of the decorrelated signal added to a dry signal mix result.

7. Apparatus in accordance with claim 6, in which the combiner is operative to calculate the weighting factors based on a multiplication of a matrix derived from eigenvalues acquired by the eigenvalue decomposition and a covariance matrix of the decorrelator signal.

8. Apparatus in accordance with claim 6, in which the combiner is operative to calculate the weighting factors such that a single decorrelator is used and the decorrelator post processing matrix P is a matrix comprising a single column and a number of lines equal to the number of channel signals in the rendered output signal, or in which two decorrelators are used, and the decorrelator post-processing matrix P comprises two columns and a number of lines equal to the number of channel signals of the rendered output signal.

9. Apparatus in accordance with claim 6 in which the combiner is operative to calculate the weighting factors based on a covariance matrix of the decorrelated signal, which is calculated based on the following equation:

$$R_z = QDED^*Q^*,$$

wherein $R_z$ is the covariance matrix of the decorrelated signal, Q is a pre-decorrelator mix matrix, D is a downmix matrix representing the downmix information, E is an audio object covariance matrix representing the parametric audio object information.

10. Apparatus in accordance with claim 5, in which the combiner is operative to calculate the weighting factors for the weighted combination so that the decorrelator post processing matrix P is calculated such that the decorrelated signal is added to two resulting channels of a dry mix operation with opposite signs.

11. Apparatus in accordance with claim 10, in which the combiner is operative to calculate the weighting factors such that the decorrelated signal is weighted by a weighting factor determined by a correlation cue between two channels of the rendered output signal, the correlation cue being similar to a correlation value determined by a virtual target rendering operation based on a target rendering matrix.

12. Apparatus in accordance with claim 11, in which a quadratic equation is solved for determining the weighting factor and in which, if no real solution for this quadratic equation exists, the addition of a decorrelated signal is reduced or deactivated.

13. Apparatus in accordance with claim 5, in which the combiner is operative to calculate the weighting factors so that the weighted combination is represent able by performing a gain compensation by weighting a dry signal mix result so that an energy error within the dry signal mix result compared to the energy of the downmix signal is reduced.

14. Apparatus in accordance with claim 1, in which the decorrelator stage is operative to perform an operation for manipulating the downmix signal wherein the manipulated downmix signal is fed to a decorrelator.

15. Apparatus in accordance with claim 14, in which the pre-decorrelator operation comprises a mix operation for mixing the first audio object downmix channel and the second audio object downmix channel based on downmix information indicating a distribution of the audio object into the downmix signal.

16. Apparatus in accordance with claim 14, in which the combiner is operative to perform the dry mix operation of the first and the second of the audio object downmix signals, in which the pre-decorrelator operation is similar to the dry mix operation.

17. Apparatus in accordance with claim 16, in which the combiner is operative to use the dry mix matrix $C_0$ in which the pre-decorrelator manipulation is implemented using a pre-decorrelator matrix Q which is identical to the dry mix matrix $C_0$.

18. Apparatus in accordance with claim 1 in which the combiner is operative to determine, whether an addition of a decorrelated signal will result in an artifact, and in which the combiner is operative to deactivate or reduce an addition of the decorrelated signal, when an artifact-creating situation is determined, and to reduce a power error incurred by the reduction or deactivation of the decorrelated signal.

19. Apparatus in accordance with claim 18, in which the combiner is operative to calculate the weighting factors such that the power of a result of the dry mix operation is increased.

20. Apparatus in accordance with claim 18, in which the combiner is operative to calculate an error covariance matrix date R representing a correlation structure of the error signal between the dry upmix signal and on output signal determined by a virtual target rendering scheme using the target rendering information, and in which the combiner is operative to determine a sign of an off-diagonal element of the error covariance matrix data R and to deactivate or reduce the addition if the sign is positive.

21. Apparatus in accordance with claim 1, further comprising:

a time/frequency converter for converting the downmix signal in a spectral representation comprising a plurality of subband downmix signals:

wherein, for each subband signal, a decorrelator operation and a combiner operation are used so that the plurality of rendered output subband signals is generated, and a frequency/time converter for converting the plurality of subband signals of the rendered output signal into a time domain representation.

22. Apparatus in accordance with claim 21 in which for each block and for each subband signal, the audio object information is provided, and in which the target rendering information and the audio object downmix information are constant over the frequency for a time block.

23. Apparatus in accordance with claim 1, further comprising a block processing controller for generating blocks of sample values of the downmix signal and for controlling the decorrelator and the combiner to process individual blocks of sample values.

24. Apparatus in accordance with claim 1 in which the combiner comprises an enhanced matrixing unit operational in linearly combining the first audio object downmix signal and the second audio object downmix signal into a dry mix signal, and wherein the combiner is operative to linearly combining the decorrelated signal into a signal, which upon channel-wise addition with the dry mix signal constitutes a stereo output of the enhanced matrixing unit, and wherein the combiner comprises a matrix calculator for computing the weighting factors for the linear combination used by the enhanced matrixing unit based on the parametric audio object information of the downmix information and the target rendering information.

25. Apparatus in accordance with claim 1, in which the combiner is operative to calculate the weighting factors so that an energy portion of the decorrelated signal in the rendered output signal is minimum and that an energy portion of a dry mix signal acquired by linearly combining the first audio object downmix signal and the second audio object downmix signal is maximum.

26. Method of synthesising an output signal comprising a first audio channel signal and a second audio channel signal, comprising;

generating a decorrelated signal comprising a decorrelated single channel signal or a decorrelated first channel signal and a decorrelated second channel signal from a downmix signal, the downmix signal comprising a first audio object downmix signal and a second audio object downmix signal, the downmix signal representing a downmix of a plurality of audio object signals in accordance with downmix information; and performing a weighted combination of the downmix signal and the decorrelated signal using weighting factors, based on a calculation of the weighting factors for the weighted combination from the downmix information, from target rendering information indicating virtual positions of the audio objects in a virtual replay set-up, and parametric audio object information describing the audio objects, wherein the performing comprises calculating a mixing matrix $C_0$ for mixing the first audio object downmix signal and the second audio object downmix signal based on the following equation:

$$C_0=AED^*(DED^*)^{-1},$$

wherein $C_0$ is the mixing matrix, wherein A is a target rendering matrix representing the target rendering information, wherein D is a downmix matrix representing the downmix information, wherein * represents a complex conjugate transpose operation, and wherein E is an audio object covariance matrix representing the parametric audio object information.

27. A non-transitory computer-readable storage medium having stored thereon a computer program comprising a program code adapted for performing the method of synthesising an output signal comprising a first audio channel signal and a second audio channel signal, the method comprising:

generating a decorrelated signal comprising a decorrelated single channel signal or a decorrelated first channel signal and a decorrelated second channel signal from a downmix signal, the downmix signal comprising a first audio object downmix signal and a second audio object downmix signal, the downmix signal representing a downmix of a plurality of audio object signals in accordance with downmix information; and performing a weighted combination of the downmix signal and the decorrelated signal using weighting factors, based on a calculation of the weighting factors for the weighted combination from the downmix information, from target rendering information indicating virtual positions of the audio objects in a virtual replay set-up, and parametric audio object information describing the audio objects, wherein the performing comprises calculating a mixing matrix $C_0$ for mixing the first audio object downmix signal and the second audio object downmix signal based on the following equation:

$$C_0=AED^*(DED^*)^{-1},$$

wherein $C_0$ is the mixing matrix, wherein A is a target rendering matrix representing the target rendering information, wherein D is a downmix matrix representing the downmix information, wherein * represents a complex conjugate transpose operation, and wherein E is an audio object covariance matrix representing the parametric audio object information when running on a processor.

* * * * *

UNITED STATES PATENT AND TRADEMARK OFFICE

CERTIFICATE OF CORRECTION

PATENT NO. : 8,515,759 B2
APPLICATION NO. : 12/597740
DATED : August 20, 2013
INVENTOR(S) : Engdegard et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 969 days.

Signed and Sealed this
Fifteenth Day of September, 2015

Michelle K. Lee

Michelle K. Lee
*Director of the United States Patent and Trademark Office*